US009511897B2

(12) United States Patent
Liao et al.

(10) Patent No.: US 9,511,897 B2
(45) Date of Patent: Dec. 6, 2016

(54) ASSEMBLABLE PALLET

(71) Applicants: AIR-BAG PACKING CO., LTD., New Taipei (TW); Tai-An Liao, New Taipei (TW)

(72) Inventors: Tai-An Liao, New Taipei (TW); Kao-Hsiung Liao, New Taipei (TW); Chieh-Hua Liao, New Taipei (TW)

(73) Assignees: AIR-BAG PACKING CO., LTD., New Taipei (TW); Tai-An Liao, New Taipei (TW)

( * ) Notice: Subject to any disclaimer, the term of this patent is extended or adjusted under 35 U.S.C. 154(b) by 0 days.

(21) Appl. No.: 15/136,447

(22) Filed: Apr. 22, 2016

(65) Prior Publication Data

US 2016/0236815 A1 Aug. 18, 2016

Related U.S. Application Data

(63) Continuation-in-part of application No. 14/804,738, filed on Jul. 21, 2015, now abandoned.

(30) Foreign Application Priority Data

Sep. 15, 2014 (TW) ..... 103131767 A
Sep. 14, 2015 (TW) ..... 104130353 A
Dec. 7, 2015 (TW) ..... 104141001 A

(51) Int. Cl.
*B65D 19/00* (2006.01)

(52) U.S. Cl.
CPC ..... *B65D 19/0095* (2013.01); *B65D 19/0026* (2013.01); *B65D 2519/00104* (2013.01);
(Continued)

(58) Field of Classification Search
CPC ..... B65D 19/0026; B65D 19/0028; B65D 19/0089;B65D 19/0095; B65D 19/0097; B65D 19/44; B65D 2519/00333; B65D 2519/00298; B65D 2519/00104; B65D 2519/00567; B65D 2519/00129; B65D 2519/00985; B65D 2519/00273; B65D 2519/00323; B65D 2519/00562; B65D 2519/00815
(Continued)

(56) References Cited

U.S. PATENT DOCUMENTS 2,918,190 A * 12/1959 Martin ..... B65D 19/0018 220/4.28
2,955,791 A * 10/1960 George ..... B65D 19/0028 108/57.31
(Continued)

FOREIGN PATENT DOCUMENTS

DE 8703808 U1 4/1987
FR 2681046 A1 3/1993
(Continued)

OTHER PUBLICATIONS

Korean Patent Office, Office Action issued on Jul. 25, 2016.
European Patent Office, Office Action issued on Aug. 10, 2016.

*Primary Examiner* — Hanh V Tran
(74) *Attorney, Agent, or Firm* — Rabin & Berdo, P.C.

(57) ABSTRACT

An assemblable pallet includes a pallet frame, first base members, second base members, and a loading plate fixed on the pallet frame. The pallet frame includes longitudinal bars and transversal bars. Each of the longitudinal bars and the transversal bars has a step-shaped positioning portion. Each of the first base members includes first step-shaped connecting portions for guiding the step-shaped positioning portion of the longitudinal bar and the step-shaped positioning portion of the transversal bar. Each of the second base members includes a second step-shaped connecting portion for guiding the step-shaped positioning portion of the lon-
(Continued)

gitudinal bar and the step-shaped positioning portion of the transversal bar. Accordingly, the longitudinal bar or the transversal bar would not be unaligned with or protruded from the base member during the assembly, and the assemblable pallet can be assembled in an efficient and convenient way.

14 Claims, 25 Drawing Sheets

(52) U.S. Cl.
CPC ..... *B65D 2519/00273* (2013.01); *B65D 2519/00288* (2013.01); *B65D 2519/00293* (2013.01); *B65D 2519/00323* (2013.01); *B65D 2519/00333* (2013.01); *B65D 2519/00373* (2013.01); *B65D 2519/00447* (2013.01); *B65D 2519/00562* (2013.01); *B65D 2519/00572* (2013.01); *B65D 2519/00985* (2013.01)

(58) Field of Classification Search
USPC ..... 108/54.1, 56.1, 56.3, 57.19
See application file for complete search history.

(56) References Cited

U.S. PATENT DOCUMENTS 3,981,249 A * 9/1976 Herrmann ..... B65D 19/0095 108/52.1
4,230,050 A * 10/1980 Mays ..... B65D 19/0095 108/57.17
4,869,179 A * 9/1989 Sammons ..... B65D 19/0073 108/56.1
5,404,829 A * 4/1995 Shuert ..... B65D 19/0022 108/57.26
5,413,052 A * 5/1995 Breezer ..... B65D 19/0012 108/56.1
5,544,374 A * 8/1996 Strobel ..... A47C 19/024 108/159
5,636,577 A * 6/1997 Gow ..... B65D 19/0095 108/51.3
5,687,653 A * 11/1997 Bumgarner ..... B65D 19/0091 108/56.3
5,758,855 A * 6/1998 Jordan ..... B65D 19/0026 156/196
5,836,255 A * 11/1998 Uitz ..... B65D 19/0069 108/57.25
6,105,512 A * 8/2000 Lin ..... B65D 19/0073 108/55.5
6,109,190 A * 8/2000 Hale ..... B65D 19/0016 108/57.25
6,199,488 B1 * 3/2001 Favaron ..... B65D 19/0012 108/57.25
6,622,642 B2 * 9/2003 Ohanesian ..... B65D 19/0012 108/53.3
7,661,373 B2 * 2/2010 Apps ..... B65D 19/0012 108/56.3
9,139,334 B2 * 9/2015 Wahl ..... B65D 19/0016
9,150,350 B2 * 10/2015 Stanek ..... B65D 90/24
9,452,864 B2 * 9/2016 Apps ..... B65D 19/0016
2002/0011194 A1 * 1/2002 Lacabanne ..... B65D 19/0085 108/57.19
2002/0112653 A1 * 8/2002 Moore, Jr. ..... B65D 19/0012 108/57.25
2003/0233963 A1 * 12/2003 Fan ..... B65D 19/0012 108/51.11
2004/0216648 A1 * 11/2004 Apps ..... B65D 19/0012 108/57.25
2004/0218276 A1 * 11/2004 Apps ..... B65D 19/0012 359/582
2006/0102055 A1 * 5/2006 Wu ..... B65D 19/0028 108/51.3
2006/0201402 A1 * 9/2006 Moore, Jr. ..... B65D 19/0012 108/57.25
2007/0256614 A1 * 11/2007 Chen ..... B65D 19/0069 108/153.1
2008/0035033 A1 * 2/2008 Liebel ..... B65D 19/0026 108/56.1
2008/0295748 A1 * 12/2008 Yoshida ..... B65D 19/0026 108/55.1
2009/0188412 A1 * 7/2009 Dubois ..... B65D 19/0022 108/57.25
2010/0154685 A1 * 6/2010 Arinstein ..... B65D 19/0018 108/57.16
2011/0303128 A1 * 12/2011 Linares ..... B65D 19/0012 108/51.3
2012/0325125 A1 * 12/2012 Apps ..... B65D 19/0014 108/57.25
2013/0174762 A1 * 7/2013 Hedley ..... B65D 19/0026 108/50.11
2014/0000218 A1 * 1/2014 Kelly ..... B65B 15/00 53/399
2014/0113092 A1 * 4/2014 Doll ..... B65D 19/385 428/36.5

FOREIGN PATENT DOCUMENTS

JP 3065500 U 2/2000
JP 2002002689 A 1/2002
KR 20120133783 A 12/2012

* cited by examiner

ASSEMBLABLE PALLET

CROSS-REFERENCES TO RELATED APPLICATIONS

This application is a continuation-in-part (OP) of application Ser. No. 14/804,738, filed on Jul. 21, 2015, with claiming foreign priority of TW 103131767. This application claims priority under 35 U.S.C. §119(a) on Patent Application No. 104130353 filed in Taiwan, R.O.C. on Sep. 4, 2015 and Patent Application No. 104141001 file in Taiwan, R.O.C. on Dec. 7, 2015. The prior applications are herewith incorporated by reference in its entirety.

BACKGROUND

Technical Field

The instant disclosure relates to a pallet, in particular, to an assemblable pallet.

Related Art

In transportation or management of goods, pallets are common tools. The pallets are for loading goods, so that a forklift truck can transport the goods in a convenient manner. In addition to the convenience, the use of the pallet prevents the goods from being damaged or getting wet during transportation or storage.

However, traditional plastic pallets are integrally formed. Molds with different sizes are used to manufacture plastic pallets with different sizes. However, the molds are quite expensive. Furthermore, the traditional plastic pallet might be useless when being damaged, even if only a small piece of the pallet is missing.

SUMMARY

How to manufacture a pallet with low cost and high usage rate and a pallet can be repaired easily is an issue for related personnel.

In view of these, the instant disclosure provides an assemblable pallet. One embodiment of the assemblable pallet comprises a pallet frame, a plurality of first base members, a plurality of second base members, and a loading plate. The pallet frame comprises a plurality of longitudinal bars and a plurality of transversal bars, wherein each of the longitudinal bars and the transversal bars has a step-shaped positioning portion. The first base members are located at corners of the pallet frame, wherein each of the first base members comprises a first base body and a plurality of first step-shaped connecting portions. The first base body has a first top surface, a first bottom surface, and a plurality of first lateral surfaces, wherein each of the first lateral surfaces is connected between the first top surface and the first bottom surface. The first step-shaped connecting portions are formed between the first top surface and two of the first lateral surfaces of the first base body, wherein the first step-shaped connecting portions are connected with each other and guide the step-shaped positioning portion of one of the longitudinal bars and the step-shaped positioning portion of one of the transversal bars, so that the longitudinal bar and the transversal bar are assembled on the first base body through the first step-shaped connecting portions. Each of the second base members is located between two of the first base members. Each of the second base members comprises a second base body and a second step-shaped connecting portion. The second body has a second top surface, a second bottom surface, and a plurality of second lateral surfaces, wherein each of the second lateral surfaces is connected between the second top surface and the second bottom surface. The second step-shaped connecting portion is formed between the second top surface and one of the second lateral surfaces of the second base body, wherein the second step-shaped connecting portion guides the step-shaped positioning portion of one of the longitudinal bars or the step-shaped positioning portion of one of the transversal bars, so that the longitudinal bar or the transversal bar is assembled on the second base body through the second step-shaped connecting portions. The loading plate is fixed on the pallet frame and attached to the pallet frame, the first top surface of the first base members, and the second top surfaces of the second base members.

Accordingly, because of the step-shaped structure, the longitudinal bars and the transversal bars can be guided and assembled with the base members. In other words, the longitudinal bars and the transversal bars may be assembled with each other to form the pallet frame, followed by assembling the first base members and the second base members to the pallet frame. Alternatively, because of the step-shaped structure, the longitudinal bars and the transversal bars may be assembled with the first base members and the second base members, followed by assembling the longitudinal bars with the transversal bars. Therefore, because of the fool-proofing design, the longitudinal bar or the transversal bar would not be unaligned with or protruded from the first top surface during the assembly, and the assemblable pallet can be assembled in an efficient and convenient way. As a result, a fool-proofing function can be performed during the assembly of the pallet frame and the first base members. In addition, when some of the components are damaged, the damaged components can be replaced by a new component. Hence, the cost for the assembable pallet can be reduced, and the assemblable pallet can be repaired easily.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
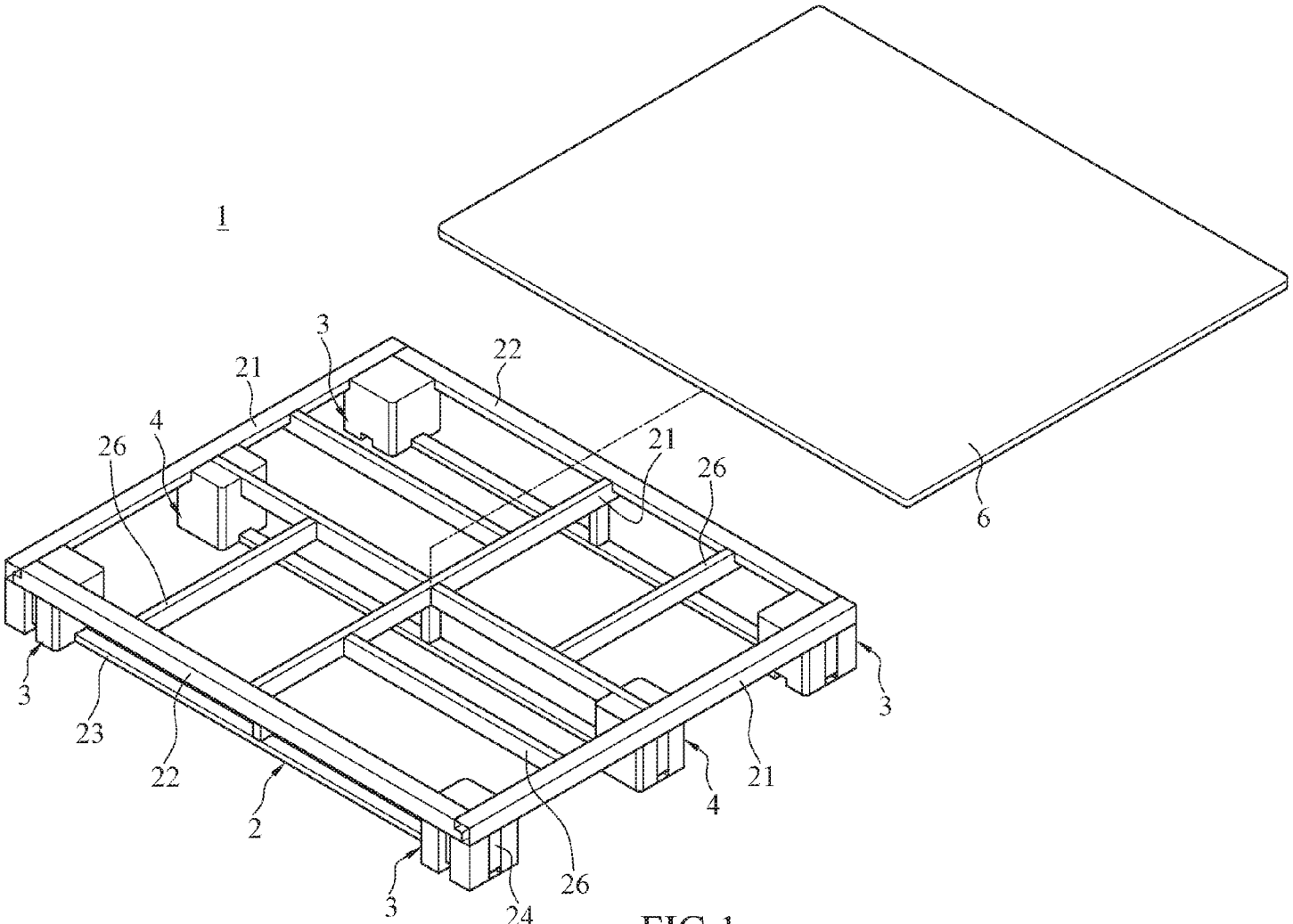
FIG. 1 illustrates a partial exploded view of an assemblable pallet according to a first embodiment of the instant disclosure.

Please refer to FIG. 1, illustrates a partial exploded view of an assemblable pallet 1 according to a first embodiment of the instant disclosure. In this embodiment, the assemblable pallet 1 comprises a pallet frame 2, a plurality of first base members 3, a plurality of second base members 4, and a loading plate 6.

Figure 2:
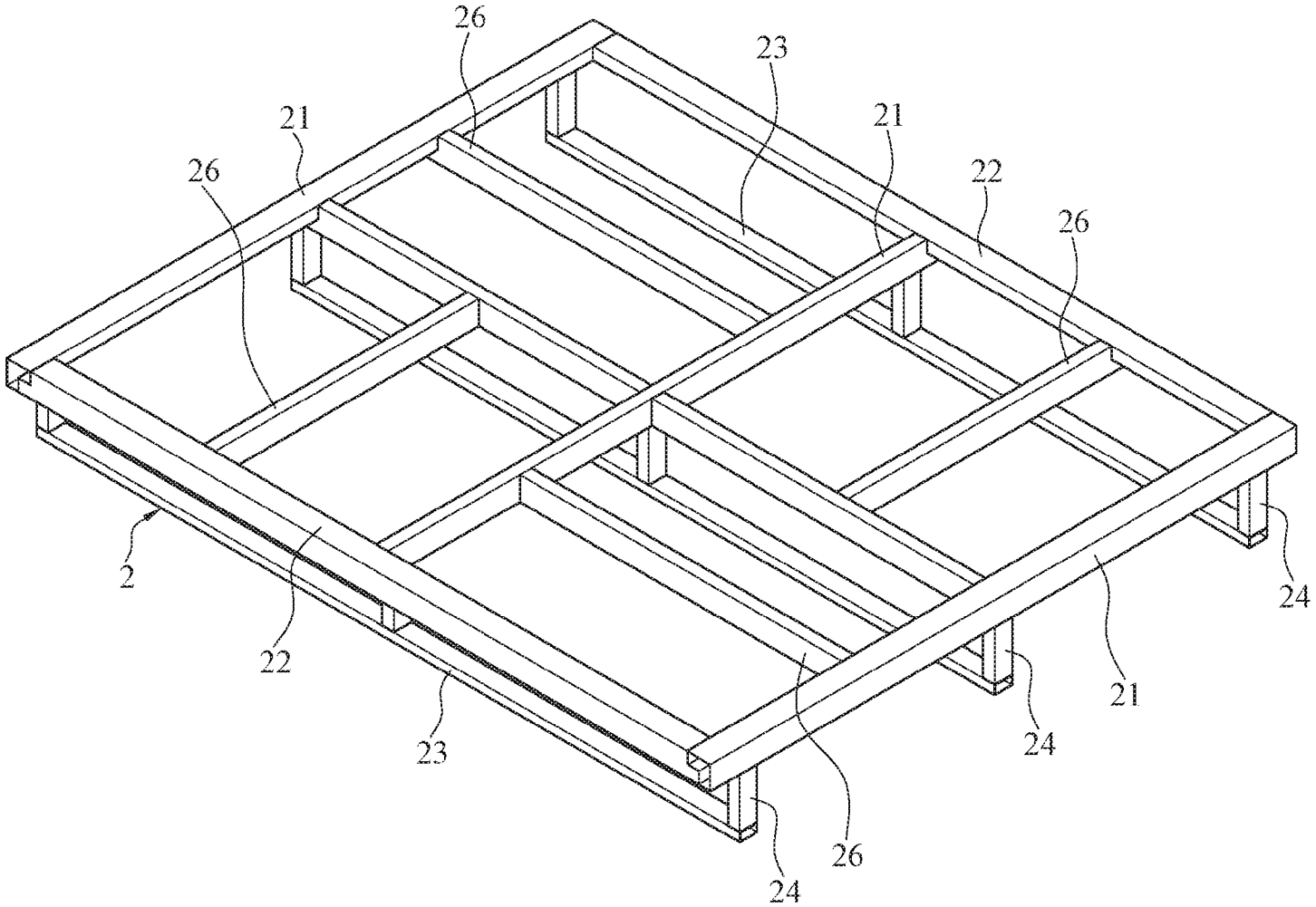
FIG. 2 illustrates a perspective view of a pallet frame of the first embodiment.
Figure 3A:
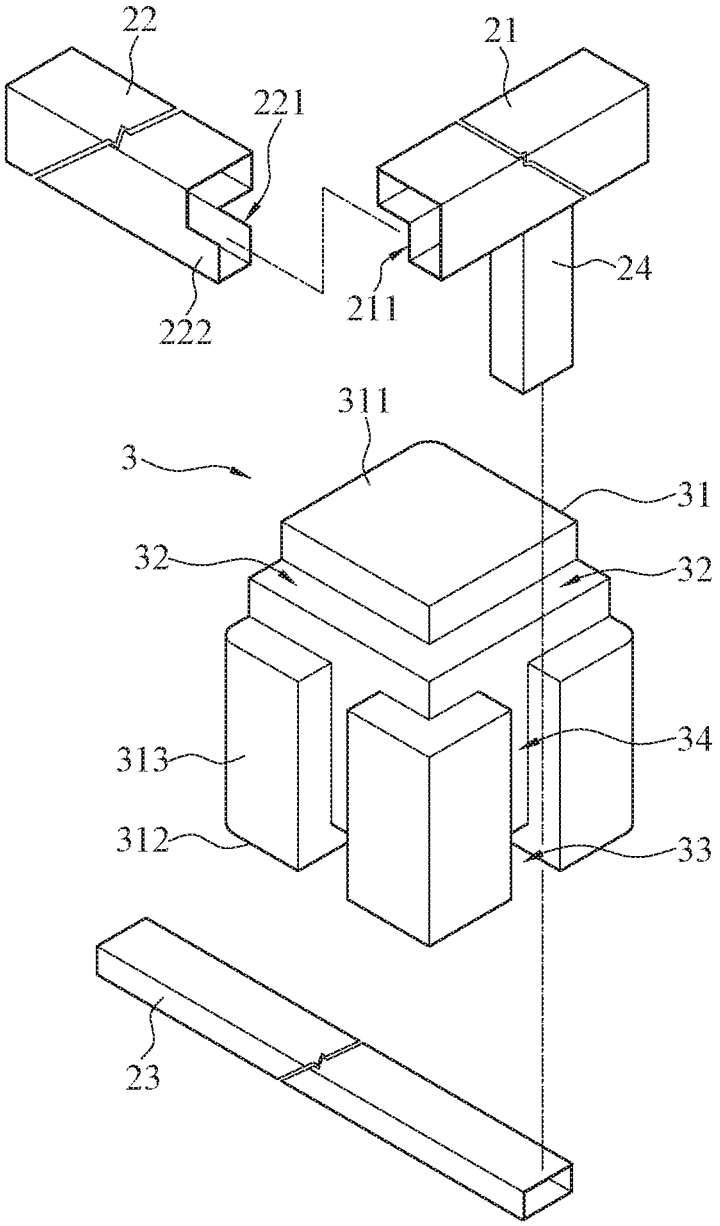
FIG. 3A illustrates a schematic exploded view of one embodiment of a first base member and the pallet frame of the first embodiment.

Please refer to FIG. 2, illustrating a perspective view of a pallet frame 2 of the first embodiment. The pallet frame 2 comprises a plurality of longitudinal bars 21 and a plurality of transversal bars 22. The longitudinal bars 21 and the transversal bars 22 may be hollowed, but embodiments are not limited thereto. In this embodiment, each of the longitudinal bars 21 has a step-shaped positioning portion 211, and each of the transversal bars 22 has a step-shaped positioning portion 221, and the step-shaped positioning portion 211, 221 has one or more step structure. As shown in FIGS. 2 and 3A, the step-shaped positioning portion 211, 221 has a two-stair step structure; while in FIG. 11, the step-shaped positioning portion 211, 221 has a one-stair step structure.

Figure 4:
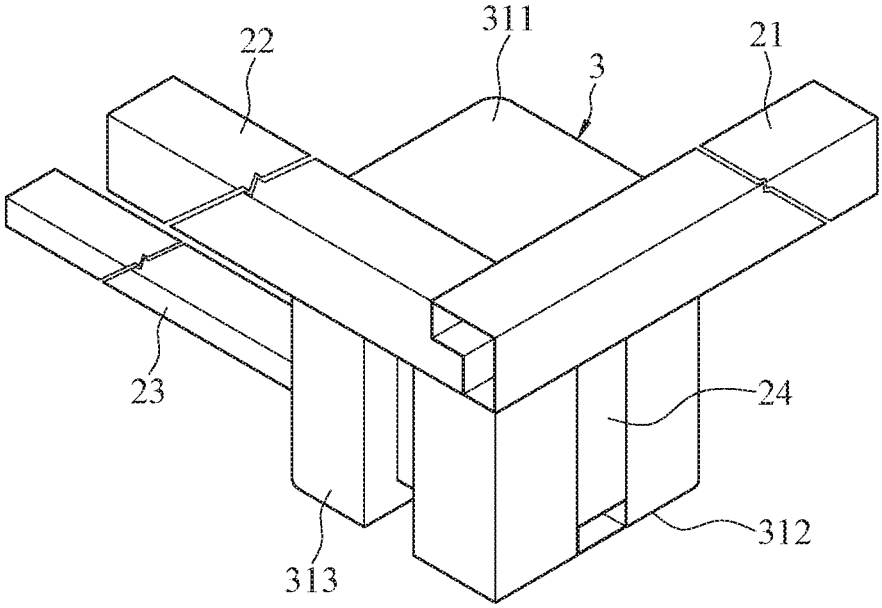
FIG. 4 illustrates a schematic assembled perspective view of the first base member and the pallet frame of the first embodiment.

Please refer to FIG. 1 and FIG. 3A. The first base members 3 are located at corners of the pallet frame 2. Each of the first base members 3 comprises a first base body 31 and a plurality of first step-shaped connecting portions 32. The first base body 31 comprises a first top surface 311, a first bottom surface 312, and a plurality of first lateral surfaces 313. Each of the first lateral surfaces 313 is connected between the first top surface 311 and the first bottom surface 312. The first step-shaped connecting portions 32 are formed between the first top surface 31 and two of the first lateral surfaces 313 of the first base body 31. In each of the first base members 31, the first step-shaped connecting portions 32 are connected with each other to form an L-shape recess, and the first step-shaped connecting portions 32 guides the step-shaped positioning portion 211 of one of the longitudinal bars 21 and the step-shaped positioning portion 221 of one of the transversal bars 22, so that the longitudinal bar 21 and the transversal bar 22 are assembled on the first base body 31 through the first step-shaped connecting portions 32. In other words, either the longitudinal bar 21 or the transversal bar 22 can be guided by the first step-shaped connecting portions 32, so that either the longitudinal bar 21 or the transversal bar 22 can be aligned with the first base member 31. Therefore, during the assembly, the longitudinal bar 21 or the transversal bar 22 would not be unaligned with or protruded from the first top surface 311, as shown in FIG. 4. Consequently, the top surface of the longitudinal bar 21 and the top surface of the transversal bar 22 can be aligned with the first top surface 311 properly and form a substantial planar surface, and an operator would not need to adjust the positions of the longitudinal bar 21 and the transversal bar 22. As a result, a fool-proofing function can be performed during the assembly of the pallet frame 2 and the first base members 30.

In this embodiment, the stair number of the first step-shaped connecting portion 32 is greater than the stair number of the step-shaped positioning portion 211 and the stair number of the step-shaped positioning portion 221. In one embodiment, the stair number of the first step-shaped connecting portion 32 is one more than the stair number of the step-shaped positioning portion 211 and the stair number of the step-shaped positioning portion 221. As shown in FIG. 3A and FIG. 4, the step-shaped positioning portion 211 and the step-shaped positioning portion 221 both have a two-stair step structure, while the first step-shaped connecting portion 32 has a three-stair step structure.

Figure 5:
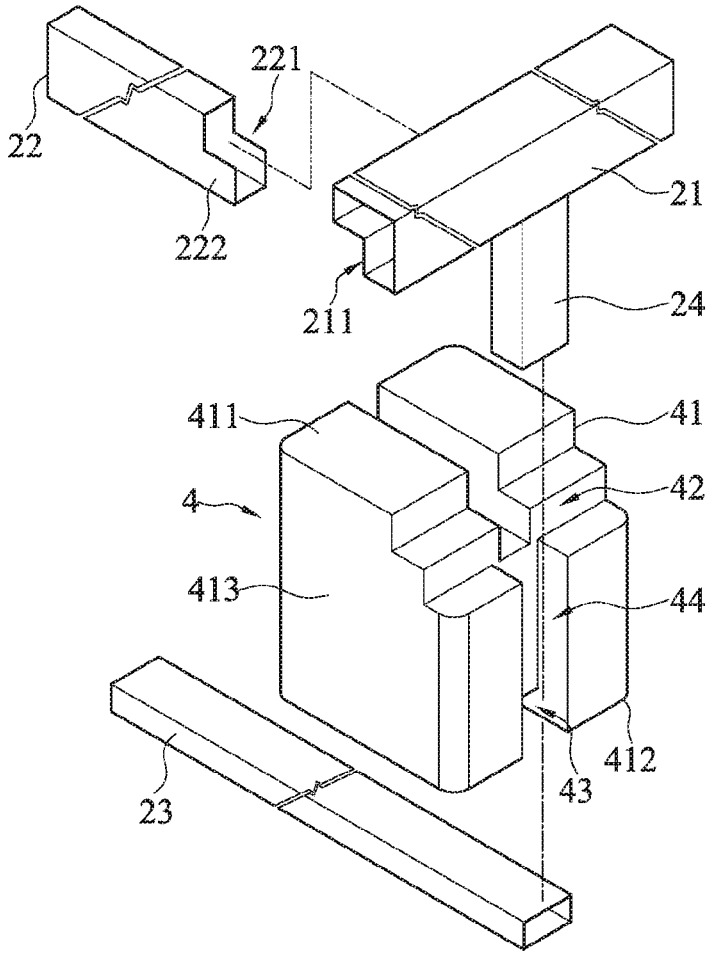
FIG. 5 illustrates a schematic exploded view of a second base member and the pallet frame of the first embodiment.
Figure 6:
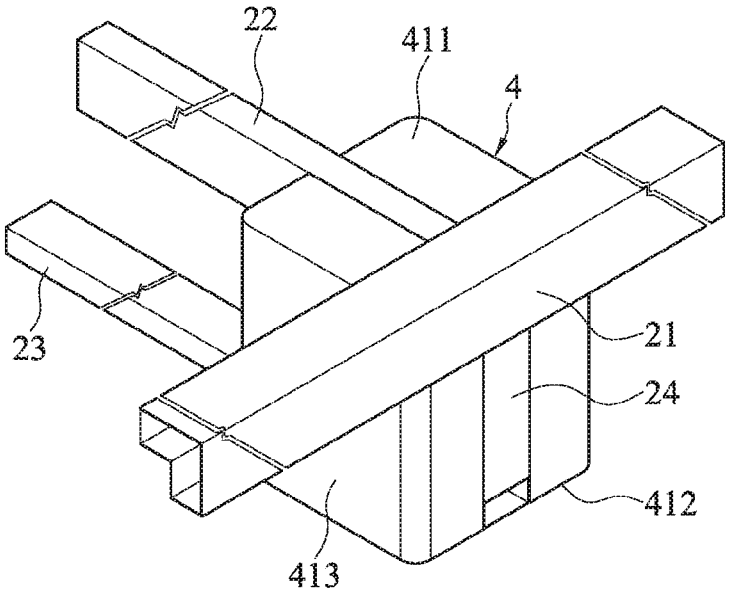
FIG. 6 illustrates a schematic assembled perspective view of the second base member and the pallet frame of the first embodiment.

As shown in FIG. 1 and FIG. 5, each of the second base members 4 is located between two of the first base members 3. Each of the second base members 4 comprises a second base body 41 and a second step-shaped connecting portion 42. The second base body 41 comprises a second top surface 411, a second bottom surface 412, and a plurality of second lateral surfaces 413. Each of the second lateral surfaces 413 is connected between the second top surface 411 and the second bottom surface 412. The second step-shaped connecting portion 42 is formed between the second top surface 411 and one of the second lateral surfaces 413 of the second base body 41. The second step-shaped connecting portion 42 guides the step-shaped positioning portion 211 of one of the longitudinal bars 21 or the step-shaped positioning portion 221 of one of the transversal bars 22, so that the longitudinal bar 21 or the transversal bar 22 is assembled on the second base body 41 through the second step-shaped connecting portion 42. Accordingly, similar to the descriptions for the first step-shaped connecting portion 32, the top surface of the longitudinal bar 21 or the top surface of the transversal bar 22 can be aligned with the second top surface 411 properly and form a substantial planar surface (as shown in FIG. 6). As a result, a fool-proofing function can be performed during the assembly of the pallet frame 2 and the second base members 41.

In this embodiment, the stair number of the second step-shaped connecting portion 42 is greater than the stair number of the step-shaped positioning portion 211 and the stair number of the step-shaped positioning portion 221. In one embodiment, the stair number of the second step-shaped connecting portion 42 is one more than the stair number of the step-shaped positioning portion 211 and the stair number of the step-shaped positioning portion 221. As shown in FIG. 5 and FIG. 6, the step-shaped positioning portion 211 and the step-shaped positioning portion 221 both have a two-stair step structure, while the second step-shaped connecting portion 42 has a three-stair step structure.

Figure 22:
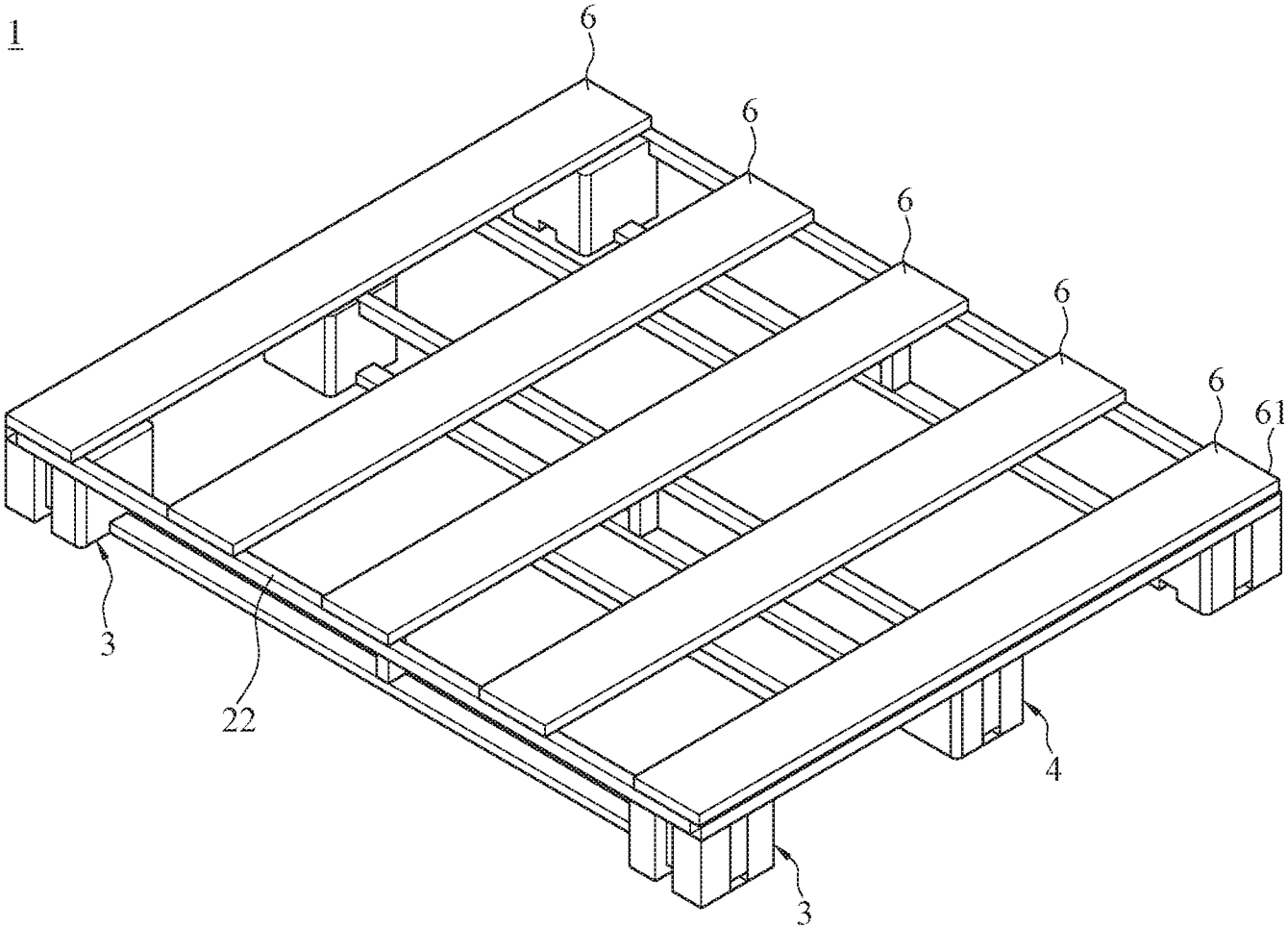
FIG. 22 illustrates a schematic perspective view of one embodiment of a loading plate of the assemblable pallet of the third embodiment.

The loading plate 6 is fixed on the pallet frame 2, and the bottom surface of the loading plate 6 is attached to the top surface of the pallet frame 2, the first top surfaces 311 of the first base members 3, and the second top surfaces 411 of the second base members 4. In this embodiment, the loading plate 6 may be formed by a single plate (as shown in FIG. 1) or a plurality of elongated plates (as shown in FIG. 22) which are fixed on the pallet frame 2 by fixing components or gluing. In addition, the two ends of each of the elongated plates comprise arced portions 61 (as shown in FIG. 22). Because the elongated plates do not have acute angles, a user or an operator would not be easily hurt by the elongated plates during the assembly or the use of the assemblable pallet 1.

Please refer to FIG. 1, because of the step-shaped structure, the longitudinal bars 21 and the transversal bars 22 can be guided and assembled with the first base members 3 and the second base members 4. In other words, the longitudinal bars 21 and the transversal bars 22 may be assembled with each other to form the pallet frame 2, followed by assembling the first base members 3 and the second base members 4 to the pallet frame 2. Alternatively, because of the step-shaped structures, the longitudinal bars 21 and the transversal bars 22 may be assembled with the first base members 3 and the second base members 4, followed by assembling the longitudinal bars 21 with the transversal bars 22.

Figure 7:
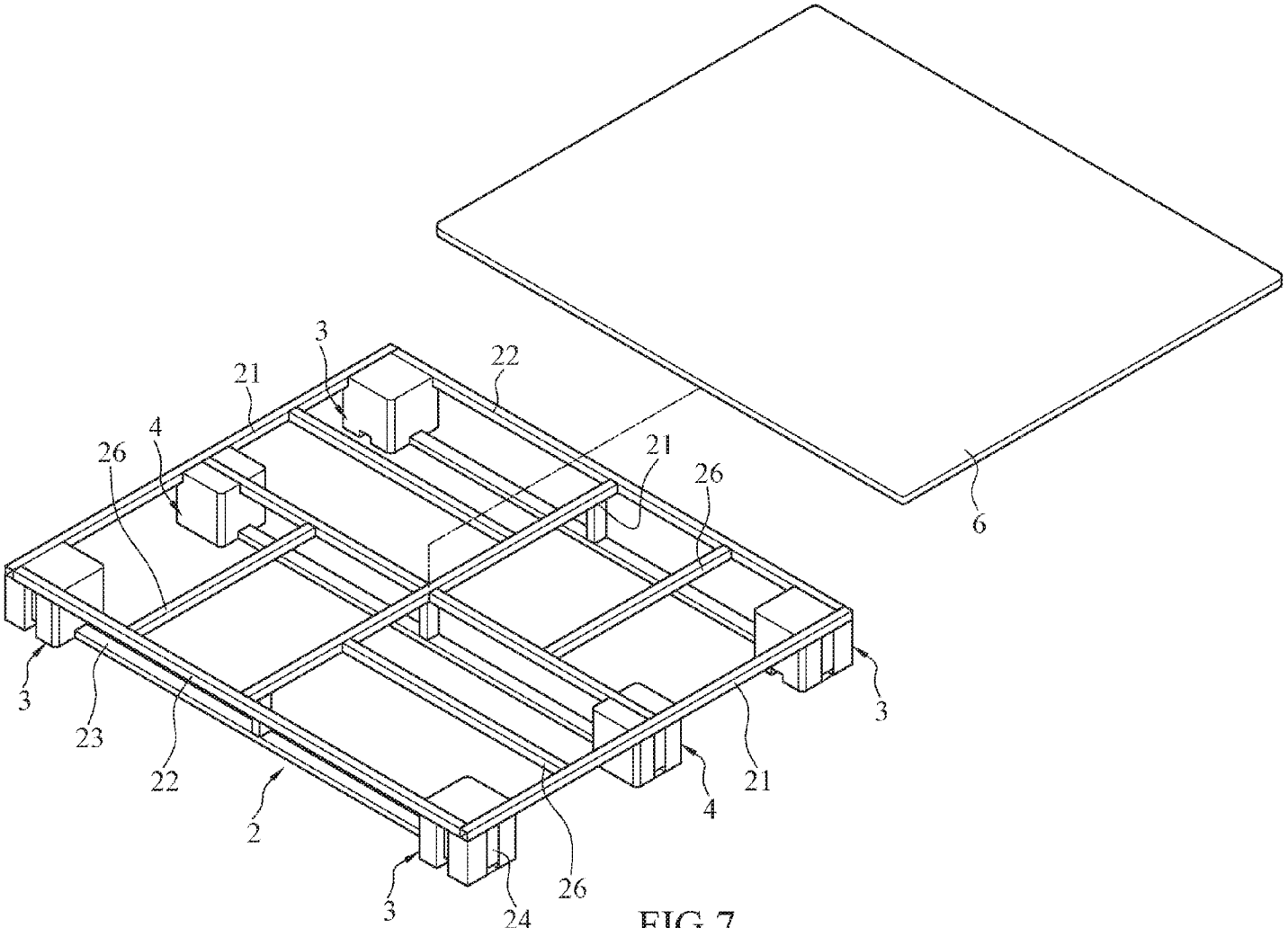
FIG. 7 illustrates a perspective view of an assemblable pallet according to a second embodiment of the instant disclosure.
Figure 8:
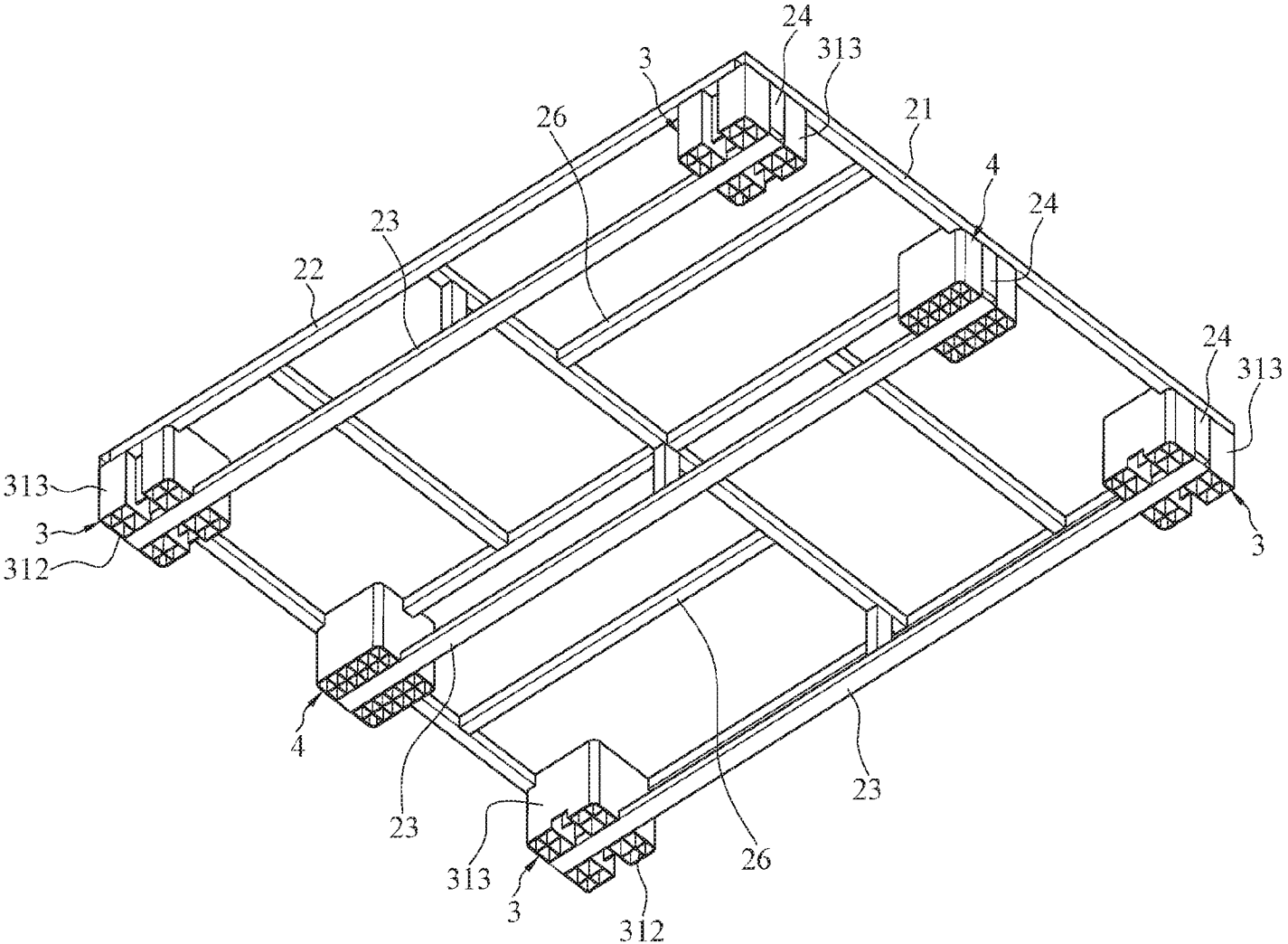
FIG. 8 illustrates another perspective view of the assemblable pallet of the second embodiment.
Figure 9:
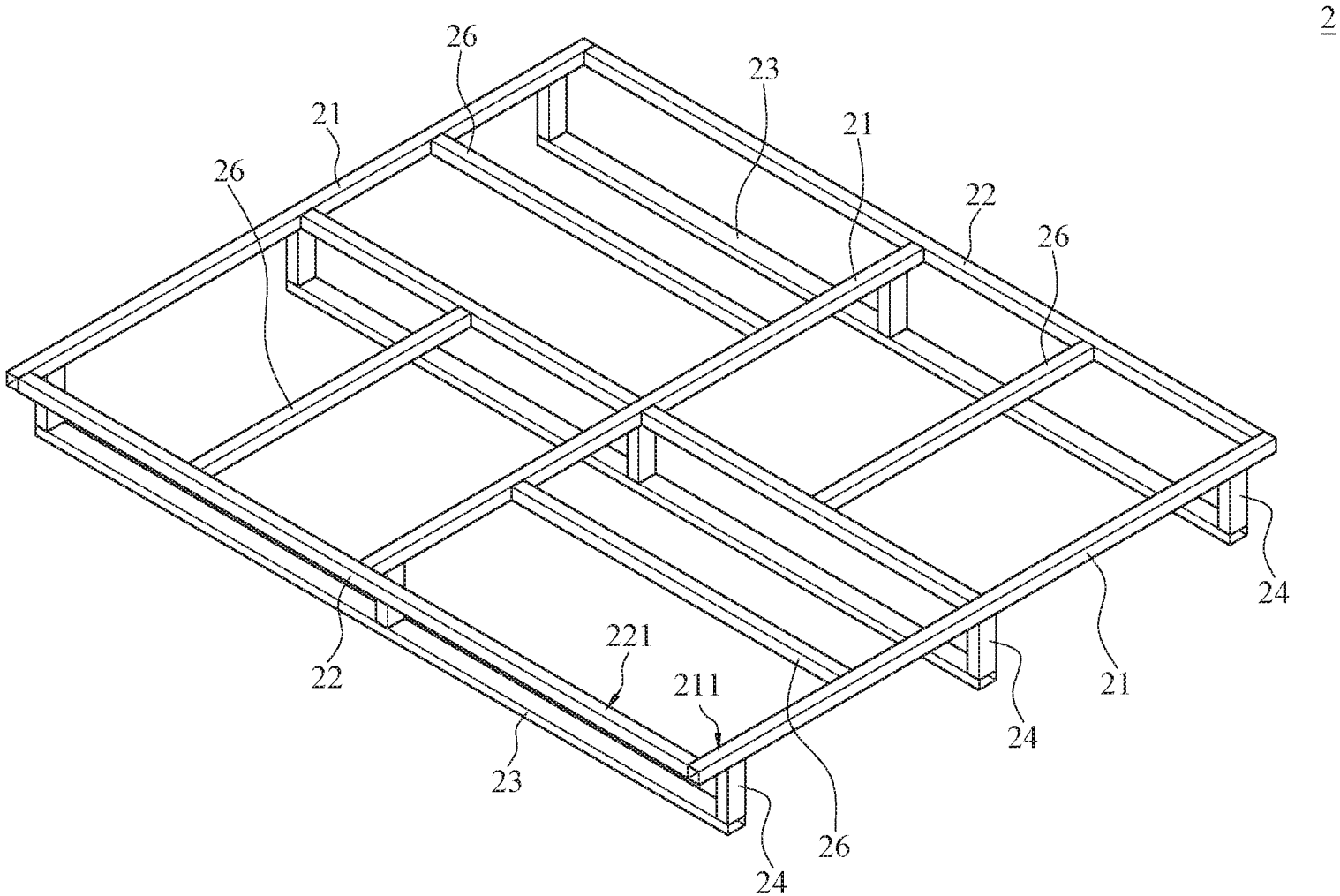
FIG. 9 illustrates a perspective view of a pallet frame of the second embodiment.
Figure 11:
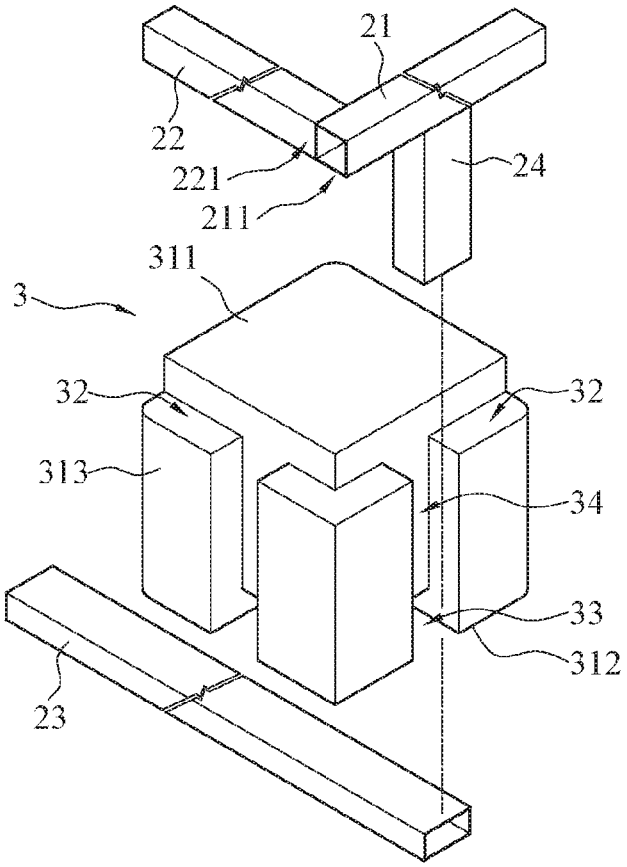
FIG. 11 illustrates a schematic exploded view of a first base member and the pallet frame of the second embodiment.

Please refer to FIGS. 7 to 9. FIG. 7 illustrates a perspective view of an assemblable pallet 1 according to a second embodiment of the instant disclosure. FIG. 8 illustrates another perspective view of the assemblable pallet 1 of the second embodiment. FIG. 9 illustrates a perspective view of a pallet frame 2 of the second embodiment. In this embodiment, each of the longitudinal bars 21 has a step-shaped positioning portion 211 and each of the transversal bars 22 has a step-shaped positioning portion 221, and the step-shaped positioning portion 211, 221 has a one-stair step structure, as shown in FIG. 11.

Figure 12:
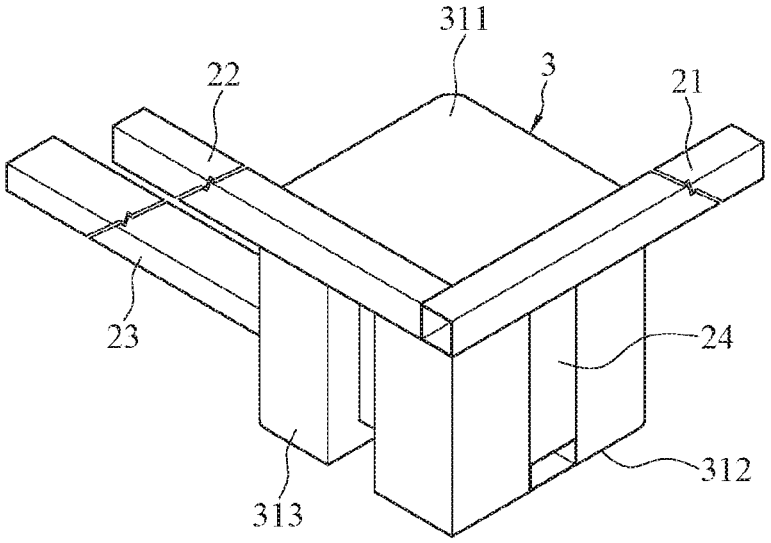
FIG. 12 illustrates a schematic assembled perspective view of the first base member and the pallet frame of the second embodiment.

In this embodiment, the stair number of the first step-shaped connecting portion 32 is greater than the stair number of the step-shaped positioning portion 211 and the stair number of the step-shaped positioning portion 221. In one embodiment, the stair number of the first step-shaped connecting portion 32 is one more than the stair number of the step-shaped positioning portion 211 and the stair number of the step-shaped positioning portion 221. As shown in FIG. 11 and FIG. 12, the first step-shaped connecting portion 32 has a two-stair step structure; conversely, the second step-shaped connecting portion 42 has a two-stair step structure.

Please refer to FIGS. 1 and 2. The pallet frame 2 further comprises a plurality of bottom supporting bars 23 and a plurality of connecting bars 24. Each of the connecting bars 24 is connected to one of the longitudinal bars 21 and one of the bottom supporting bars 23 or connected to one of the transversal bars 22 and one of the bottom supporting bars 23. In addition, as shown in FIG. 3A and FIG. 4, the first base member 3 further comprises a first fixing groove 33 formed on the first bottom surface 312 thereof; similarly, as shown in FIG. 5 and FIG. 6, the second base member 4 further comprises a second fixing groove 43 formed on the second bottom surface 412 thereof. Some of the bottom supporting bars 23 are held in two first fixing grooves 33 of two first base members 3 so as to position the two first base members 3, and the rest of the bottom supporting bars 23 are held in two second fixing grooves 43 of two second base members 4 so as to position the two second base members 4.

Figure 15:
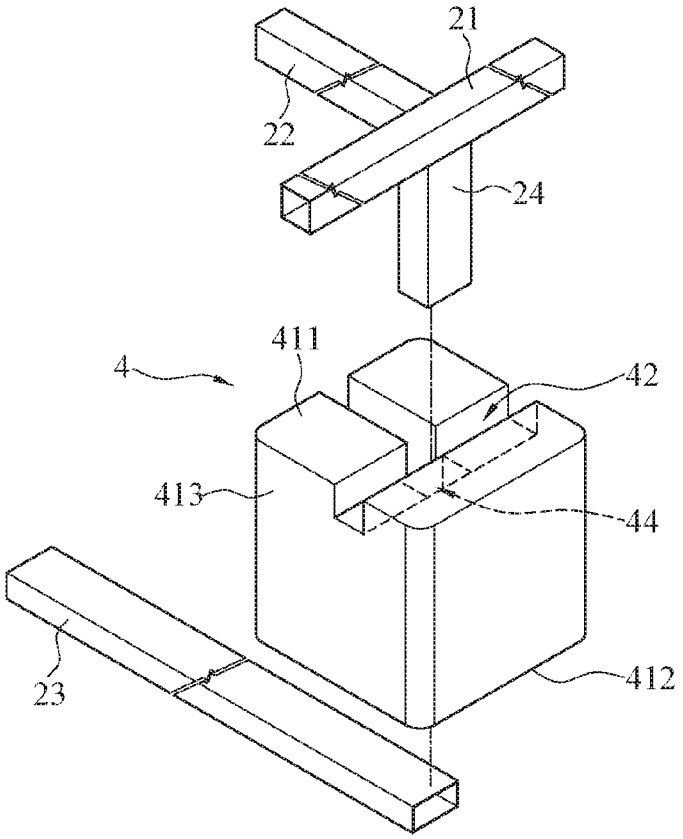
FIG. 15 illustrates a schematic exploded view of another embodiment of the second base member and the pallet frame of the second embodiment.
Figure 16:
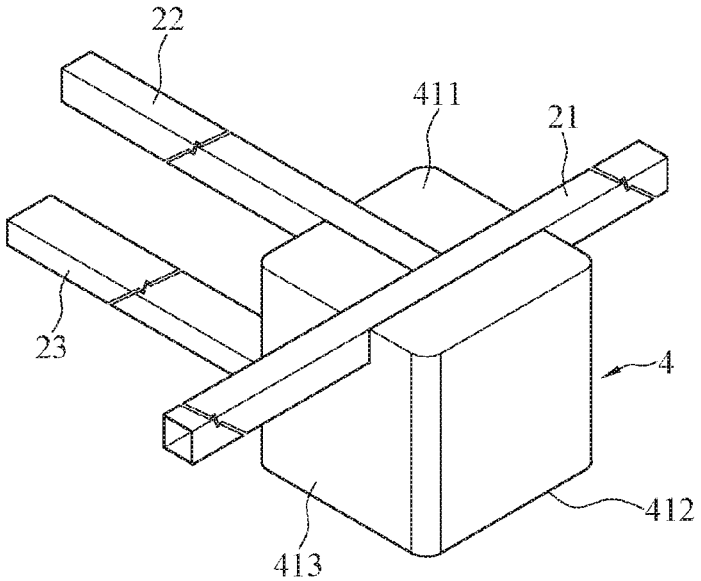
FIG. 16 illustrates a schematic assembled perspective view of another embodiment of the second base member and the pallet frame of the second embodiment.

Please refer to FIGS. 3A and 4. The first base member 3 further comprises a first connecting groove 34 formed on one of the first lateral surfaces 313 for allowing the connecting bar 24 to be held in the first base member 3, so that the connecting bar 24 and the first lateral surface 313 form a substantial planar surface. The first connecting groove 34 is connected to one of the first step-shaped connecting portion 42 and the first fixing groove 33. Please refer to FIGS. 5 and 6. The second base member 4 further comprises a second connecting groove 44 formed on one of the second lateral surfaces 413 for allowing the connecting bar 24 to be held in the second base member 4, so that the connecting bar 24 and the second lateral surface 413 form a substantial planar surface. The second connecting groove 44 is connected to the second step-shaped connecting portion 42 and the second fixing groove 43. In addition, as shown in FIGS. 15 and 16, the second step-shaped connecting portion 42 is approximately located at the middle portion of the second top surface 411, and the second connecting groove 44 is located at the inner side of the second step-shaped connecting portion 42 and further penetrating through the second bottom surface 412, and the second step-shaped connecting portion 42 and the second connecting groove 44 are respectively for inserting the longitudinal bar 21 and the connecting bar 24. It is understood that, similar structural arrangements may be applied to the first base members 3.

Figure 10:
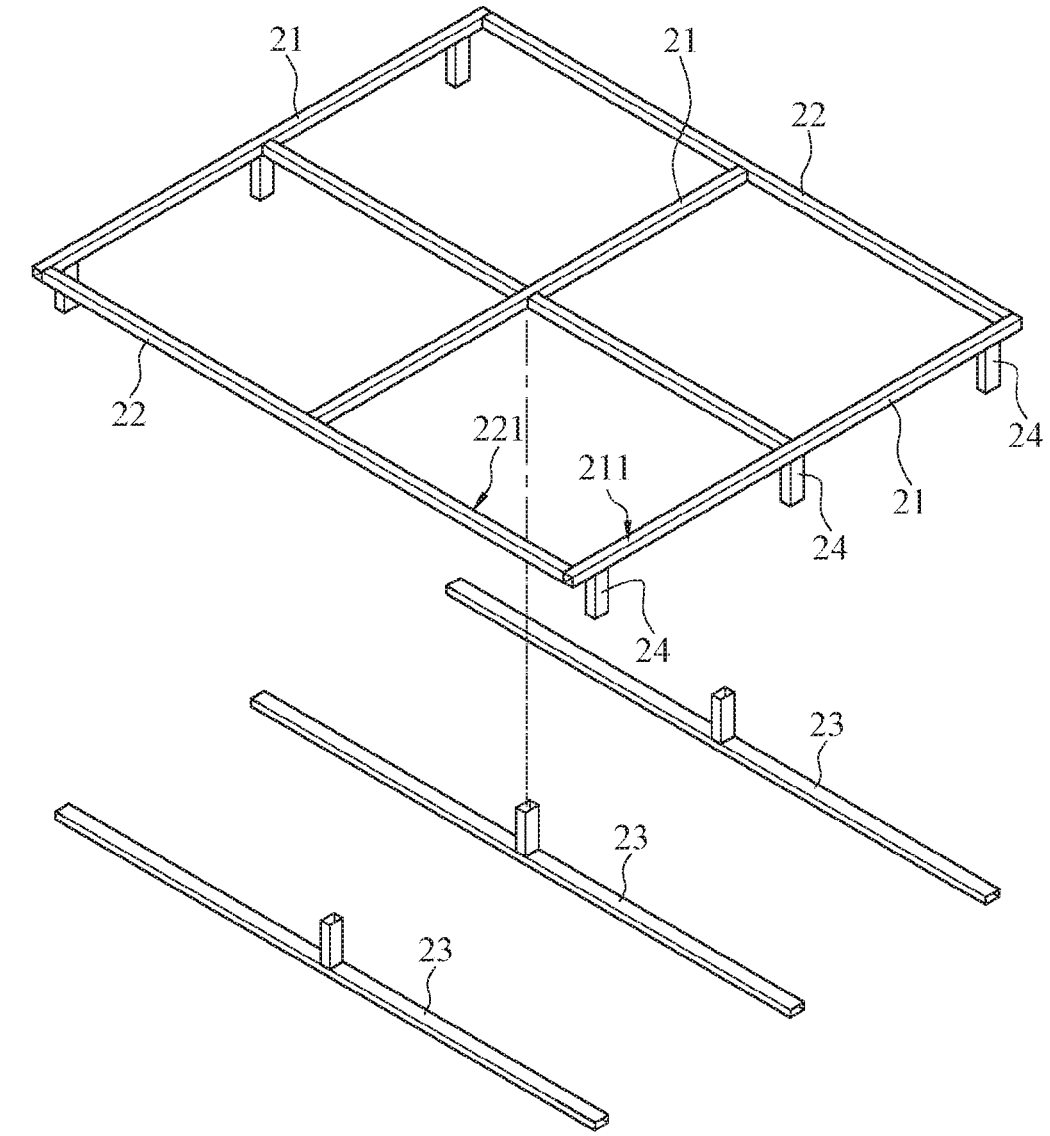
FIG. 10 illustrates an exploded view of another embodiment of the pallet frame of the second embodiment.

Please refer to FIGS. 9 and 10. Each of the longitudinal bars 21 has a step-shaped positioning portion 211 and each of the transversal bars 22 has a step-shaped positioning portion 221, and the step-shaped positioning portion 211, 221 has a one-stair step structure. In addition, the pallet frame 2 may further comprise a plurality of bottom supporting bars 23 and a plurality of connecting bars 24. The details of the bottom supporting bars 23 and the connecting bars 24 are mentioned above, and repeated detail is omitted.

Please refer to FIGS. 2 and 9. The pallet frame 2 further comprises a plurality of reinforced bars 26 connected to the longitudinal bars 21 or the transversal bars 22. In one embodiment, one of the reinforced bars 26 is connected to the longitudinal bars 21, and the adjacent reinforced bar 26 is connected to the transversal bars 22. In other words, the adjacent two reinforced bars 26 are substantially perpendicular with each other. For example, as shown in FIGS. 2 and 9, the reinforced bar 26 at the upper right portion of the pallet frame 2 is aligned longitudinally (with respect to the pallet frame 2) and connected to the transversal bars 22, while the reinforced bars 26 at the upper left portion and the lower right portion of the pallet frame 2 are aligned transversally (with respect to the pallet frame 2) and connected to the longitudinal bars 21. Because of the alternate structural arrangement of the reinforced bars 26, the overall structural strength of the pallet frame 2 can be efficiently improved.

Figure 3B:
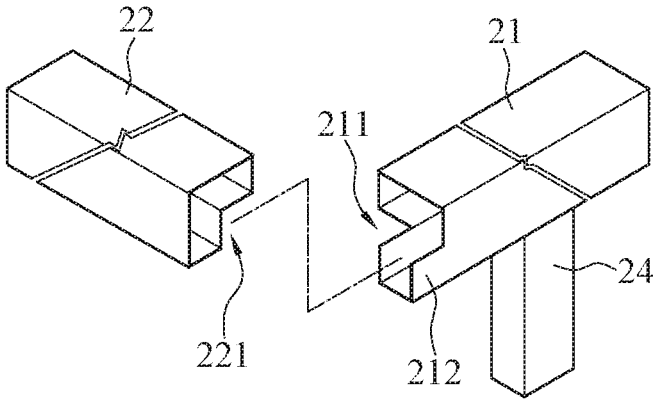
FIG. 3B illustrates a schematic assembled view of another embodiment of a longitudinal bar and a transversal bar of the first embodiment.

Please refer to FIG. 3A. One end of the step-shaped positioning portion 221 of the transversal bar 22 is extending to form a protruded portion 222, and the protruded portion 222 is held in the step-shaped positioning portion 211 of the longitudinal bar 21, so that the transversal bar 22 is assembled to the longitudinal bar 21. Because of the protruded portion 222, the transversal bar 22 and the longitudinal bar 21 can be firmly assembled with each other. While in some embodiments, as shown in FIG. 3B, one end of the step-shaped positioning portion 211 of the longitudinal bar 21 is extending to form a protruded portion 212, and the protruded portion 212 is held in the step-shaped positioning portion 221 of the transversal bar 22, so that the longitudinal bar 21 is assembled to the transversal bar 22.

Figure 17:
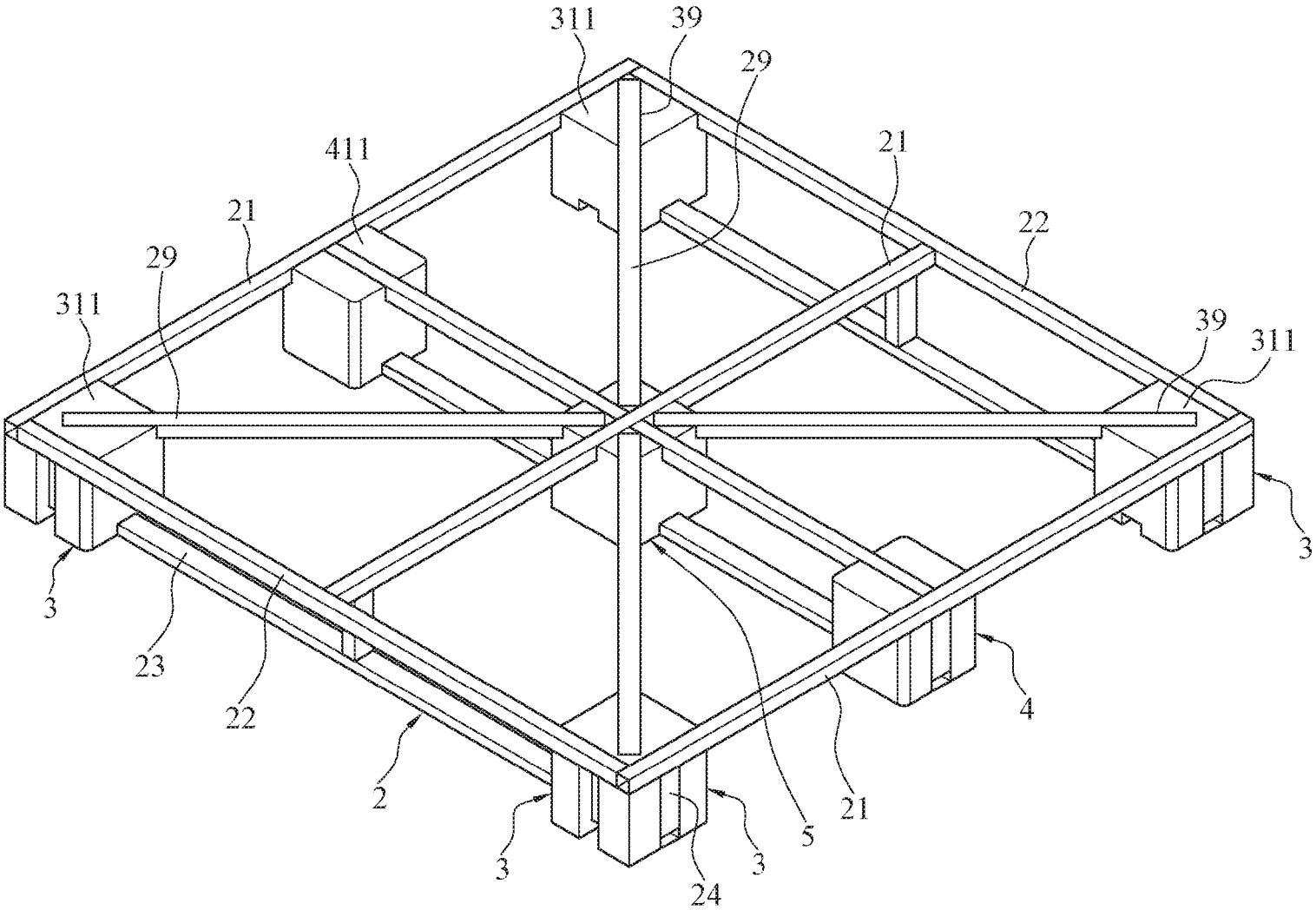
FIG. 17 illustrates a perspective view of a pallet frame of an assemblable pallet according to a third embodiment of the instant disclosure.
Figure 18:
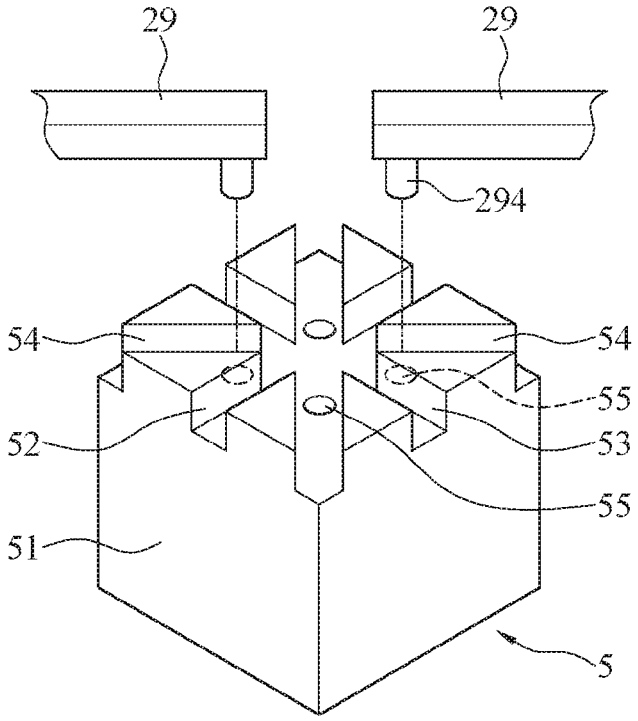
FIG. 18 illustrates a schematic exploded view a central base member and a slanted bar of the third embodiment.
Figure 19:
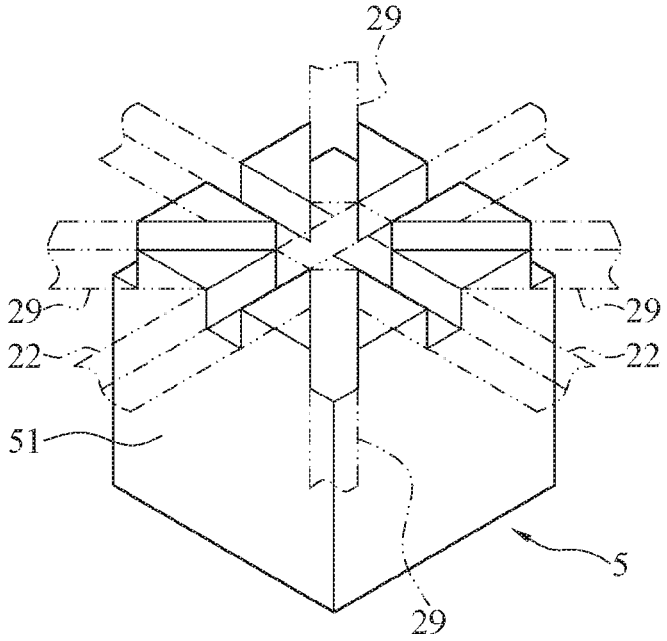
FIG. 19 illustrates a schematic assembled perspective view of the central base member and the slanted bar of the third embodiment.

Please refer to FIGS. 17 to 19. In this embodiment, the assemblable pallet 1 further comprises a central base member 5. The central base member 5 may be a structure formed by plastic injection molding art, or may be a structure formed by mixed injection molding (mixing plastic and sawdust). In this embodiment, the central base member 5 may be, but not limited to, a polyhedron, such as a cube or a cuboid. Alternatively, the central base member 5 may be of round, oblong, or irregular shape. The first base members 3, the second base members 4 are arranged at the sides of the central base member 5.

The central base member 5 further comprises a central base body 51 and a plurality of central fixing grooves 52. The central fixing grooves 52 are intersected with each other and arranged symmetrically about a center of the central base body 51. That is, the central fixing grooves 52 comprise a plurality of central slots 53. The central slots 53 are in communication with each other and defined through the center of the central base body 51 to form a cross-like pattern.

Figure 20:
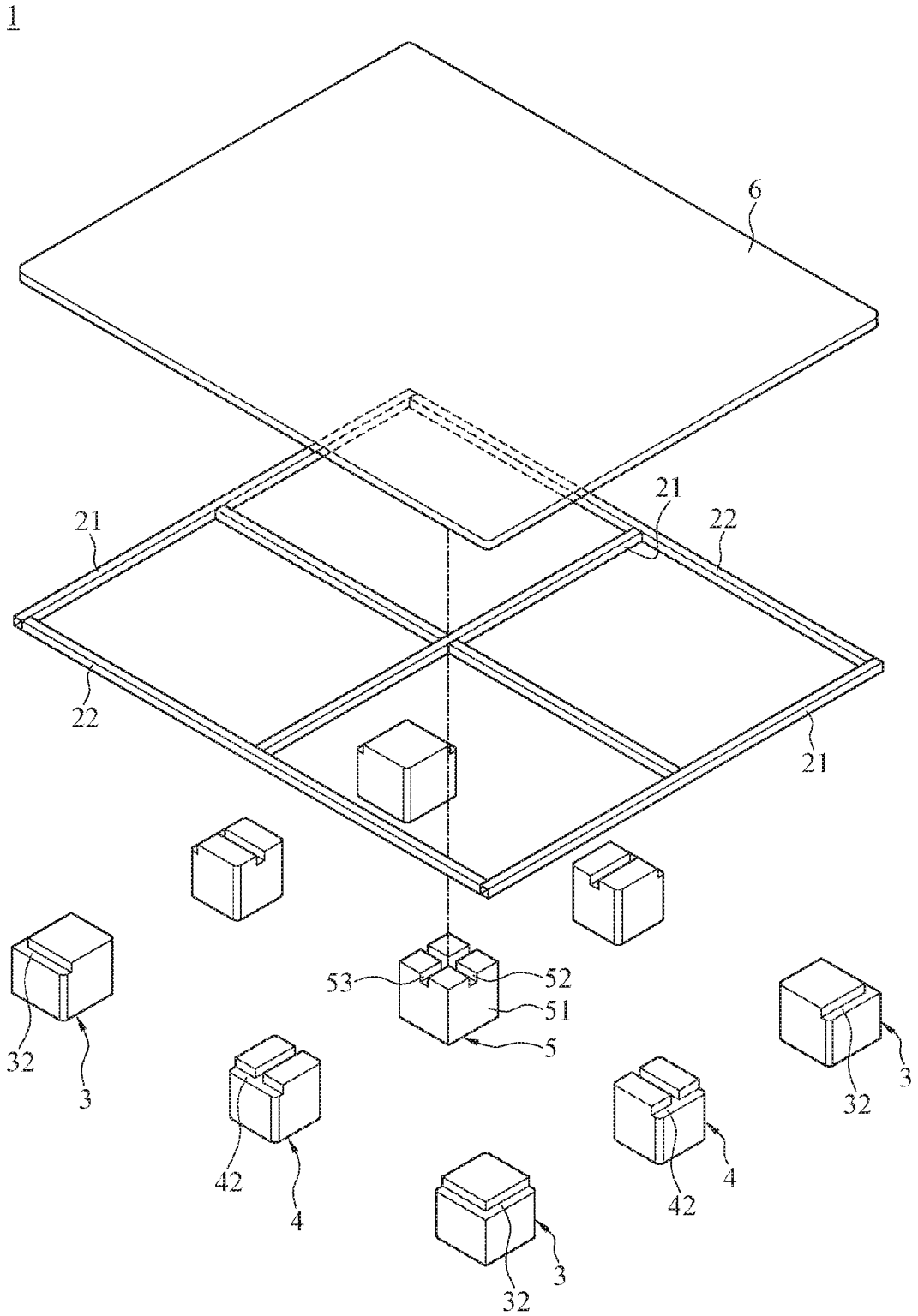
FIG. 20 illustrates a perspective view (1) of the central base member of the third embodiment.

Moreover, the central base member 5 further comprises a plurality of central angled slots 54 recessed from the top surface of the central base body 51. In this embodiment, the central base member 5 comprises four central angled slots 54 respectively located at four corners of the central base body 51. Each of the central angled slots 54 is extending toward the center of the central base body 51 and does not communicate with other central angled slots 54, but embodiments are not limited thereto. In some embodiments, each of the central angled slots 54 is extending toward the center of the central base body 51 and communicates with other central angled slots 54. In addition, as shown in FIG. 20, the central base member 5 may not comprise the four central angled slots 54.

As shown in FIGS. 17 and 18, in addition, the central slots 53 and the central angled slots 54 are intersected with each other to form a star-like pattern. Accordingly, the central slots 53 and the central angled slots 54 may be in communication with each other. Moreover, each of the first base members 3 comprises a slanted connecting portion 39 formed as a groove and located at the first top surface 311. The slanted connecting portions 39 of the first base members 3 correspond to the central angled slots 54, respectively. The pallet frame 2 further comprises a plurality of slanted bars 29 each between two of the longitudinal bars 21 or two of the transversal bars 22. Accordingly, two ends of each of the slanted bars 29 are respectively held in the slanted connecting portion 39 and the central angled slot 54, so that the whole pallet frame 2 can be firmly fixed on the first base members 3, the second base members 4, and the central base member 5. In addition, for the slanted connecting portion 39 and the central angled slot 54, the width of the interior section is smaller than the width of the opening section. Therefore, the size of the assemblable pallet 1 can be adjusted freely in its length direction, width direction, and diagonal direction, as shown in FIGS. 24 and 26.

Furthermore, the central base member 5 further comprises a plurality of inserting holes 55, each of the first base members 3 further comprises a plurality of inserting holes 35, and each of the second base members 4 further comprises a plurality of inserting holes 45. The inserting holes 55, 35, 45 are respectively formed in the central fixing groove 52, the first step-shaped connecting portions 32, and the second step-shaped connecting portions. Conversely, the longitudinal bars 21 have positioning portions 214 protruded therefrom, the transversal bars 22 have positioning portions 224 protruded therefrom, and the slanted bars 29 have positioning portions 294 protruded therefrom. The positioning portions 214, 224, 294 are respectively inserted into the inserting holes 35, 45, 55, so that the pallet frame 2 is firmly fixed on the first base members 3, the second base members 4, and the central base member 5.

Figure 23:
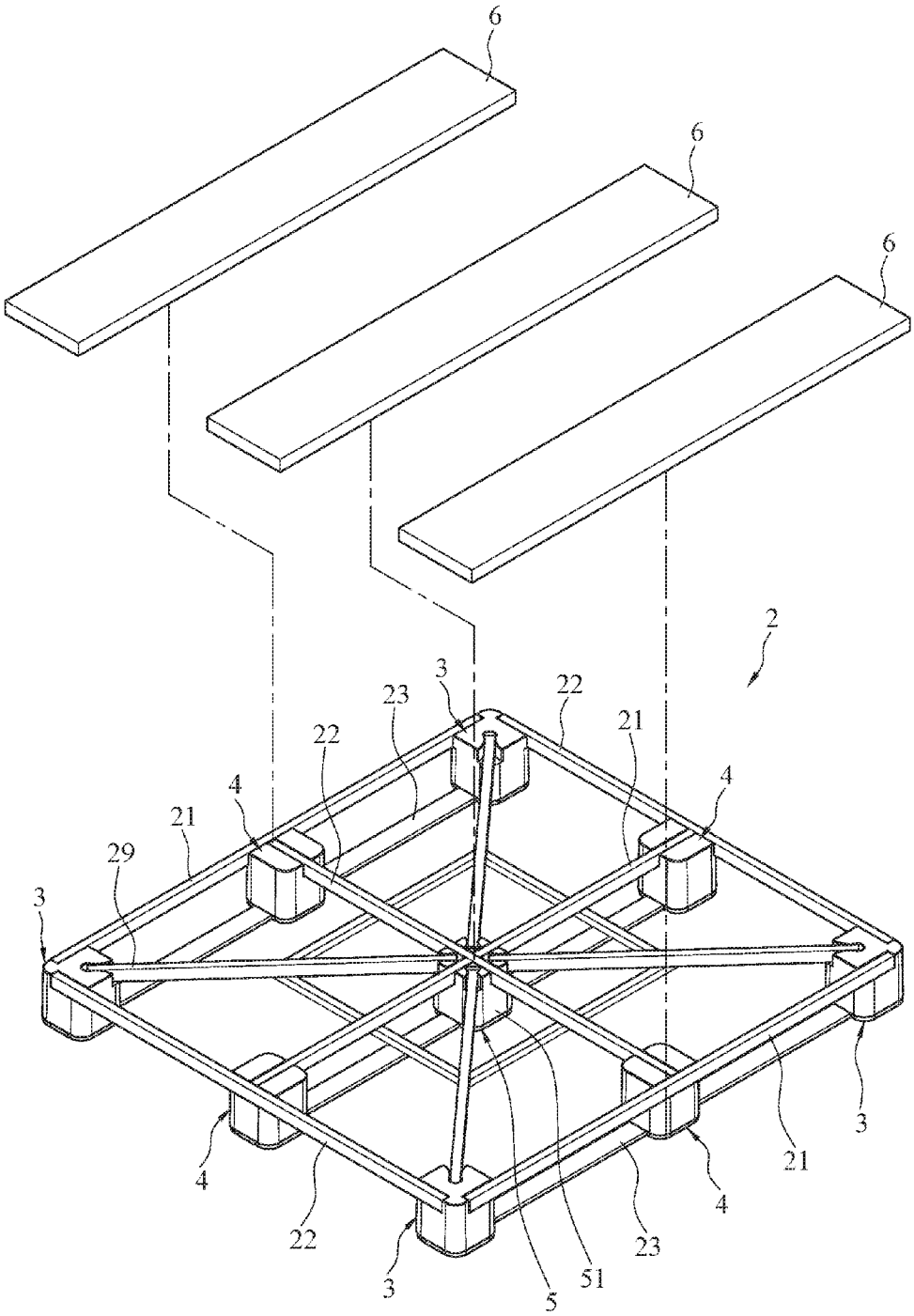
FIG. 23 illustrates a partial exploded view of an assemblable pallet according to a fourth embodiment of the instant disclosure.
Figure 24:
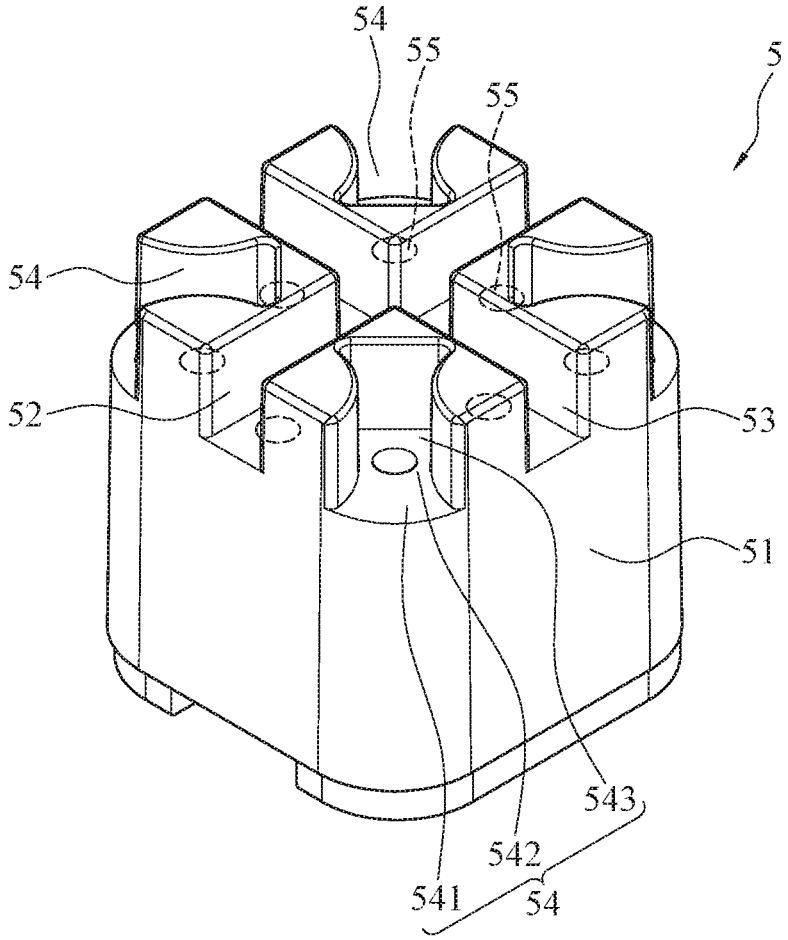
FIG. 24 illustrates a perspective view of a central base member of the fourth embodiment.
Figure 25:
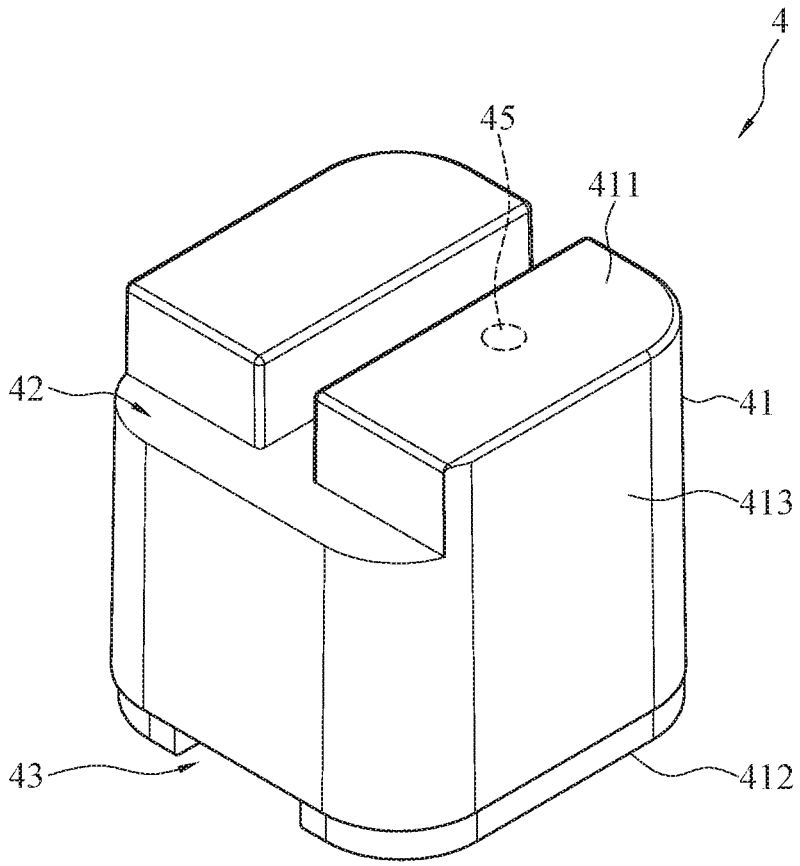
FIG. 25 illustrates a perspective view of a second base member of the fourth embodiment.
Figure 26:
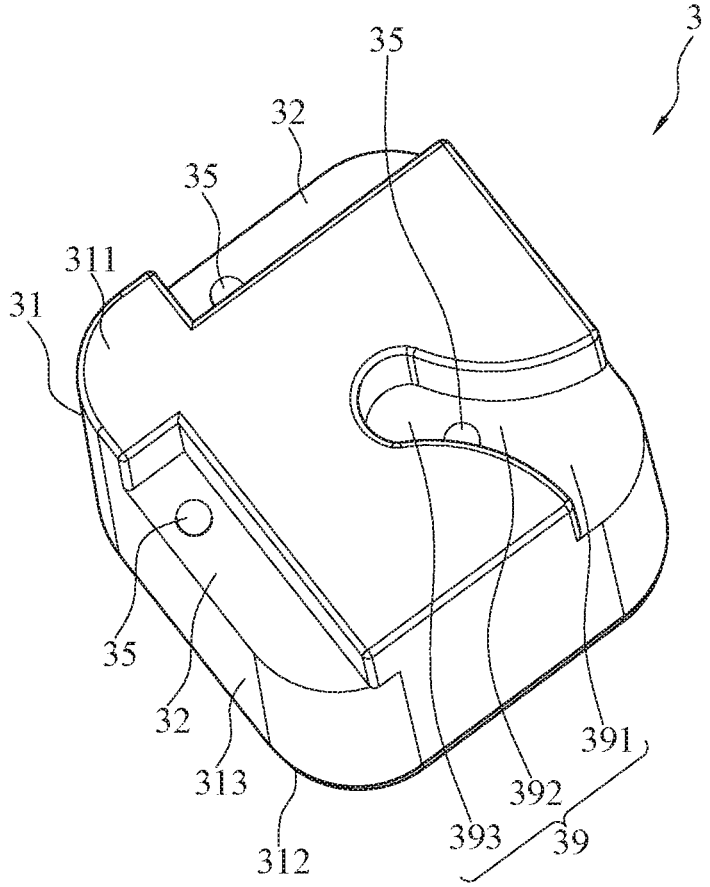
FIG. 26 illustrates a perspective view of a first base member of the fourth embodiment.

Please refer to FIGS. 23, 24, and 26, illustrating an assemblable pallet 1 according to a fourth embodiment of the instant disclosure. In this embodiment, the central base member 5 and the first base members 3 each has a funnel shape (or of gourd shape) groove structure (i.e., the central angled slots 54 and the slanted connecting portions 39). In addition, in this embodiment, each of the central angled slots 54 comprises, along a direction toward the center of the central base body 51, a central exterior expanding section 541, a central connecting section 542, and a central interior expanding section 543. From a top view, each of the central angled slots 54 is of funnel shape (or of gourd shape). In other words, the central connecting section 542 of each of the central angled slots 54 is the neck portion of the slot, i.e., the width of the central connecting section 542 is smaller than the width of the central interior expanding section 543 and the width of the central exterior expanding section 541. The width of the central exterior expanding section 541 may be equal to or smaller than the width of the central interior expanding section 543. In addition, the central exterior expanding section 541 is opened, so that a bar structure can be inserted into and held in the central angled slot 54 from the central exterior expanding section 541.

Please refer to FIGS. 23 and 26. Each of the slanted connecting portions 39 comprises, along a direction toward the center of the first base body 31, a first exterior expanding section 391, a first connecting section 392, and a first interior expanding section 393. The details of the structure of the first exterior expanding section 391, the first connecting section 392, and the first interior expanding section 393 are similar to that of the central exterior expanding section 541, the central connecting section 542, and the central interior expanding section 543 as mentioned above, and repeated detail is omitted.

Figure 29:
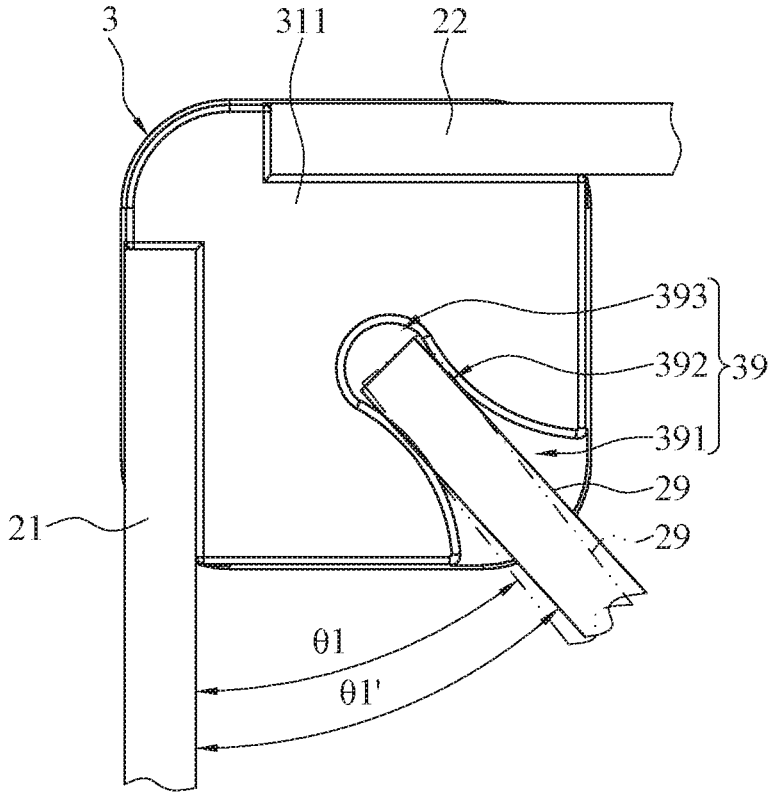
FIG. 29 illustrates a schematic enlarged view of the first base member and a slanted bar of the fourth embodiment.

Please refer to FIGS. 23, 24, and 26. In assembly, one of two ends of the slanted bar 29 is passing through the central exterior expanding section 541 and inserted into the central angled slot 54. The central connecting section 542 abutted against the slanted bar 29, so that the slanted bar 29 can be rotated about the central connecting section 542 in the central exterior expanding section 541 and the central interior expanding section 543. Conversely, the other end of the slanted bar 29 is passing through the first exterior expanding section 391 and inserted into the slanted connecting portion 39. The first connecting section 392 is abutted against the slanted bar 29, so that the slanted bar 29 can be rotated about the first connecting section 392 in the first exterior expanding section 391 and the first interior expanding section 393, as shown in FIG. 29, the angle between the slanted bar 29 and the longitudinal bar 21 changes from θ1 to θ1'.

Figure 27:
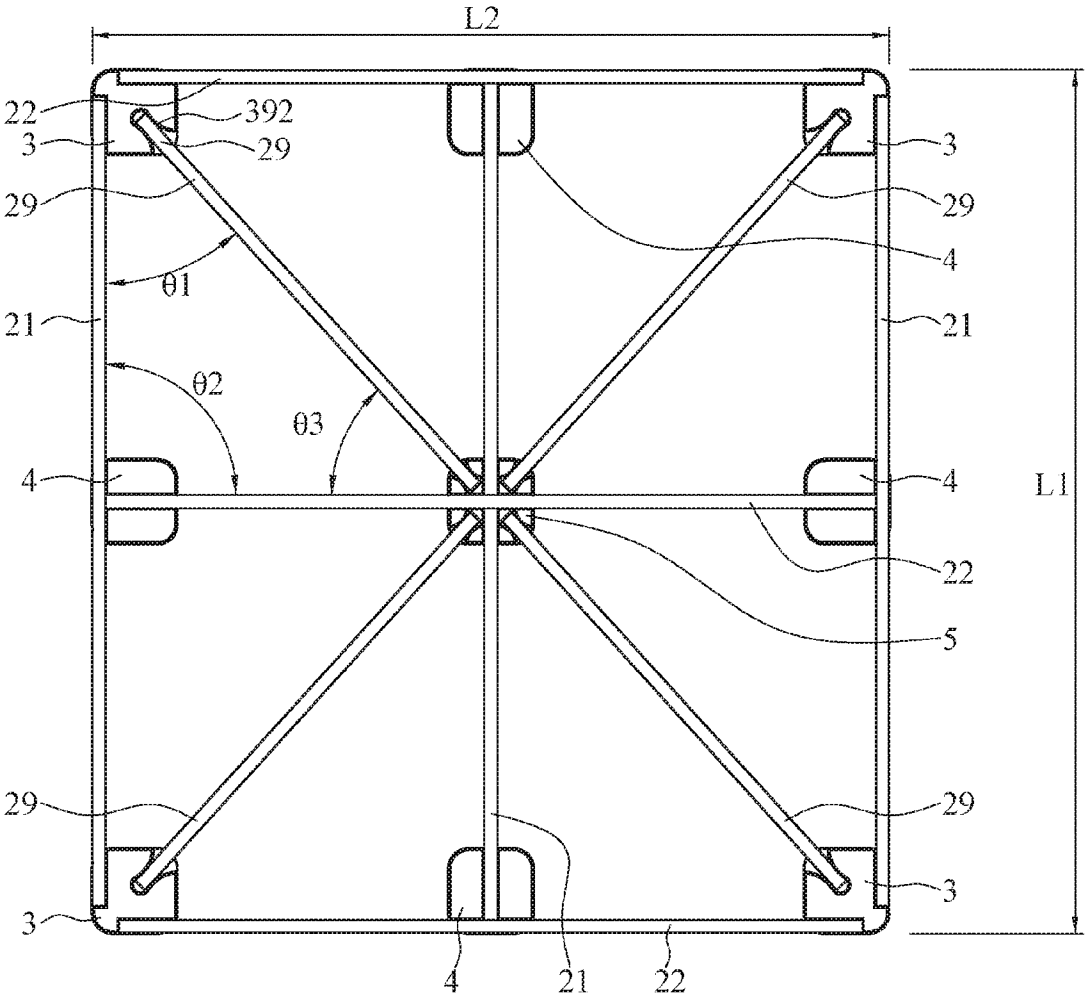
FIG. 27 illustrates a top plan view (1) of a pallet frame of the fourth embodiment.
Figure 28:
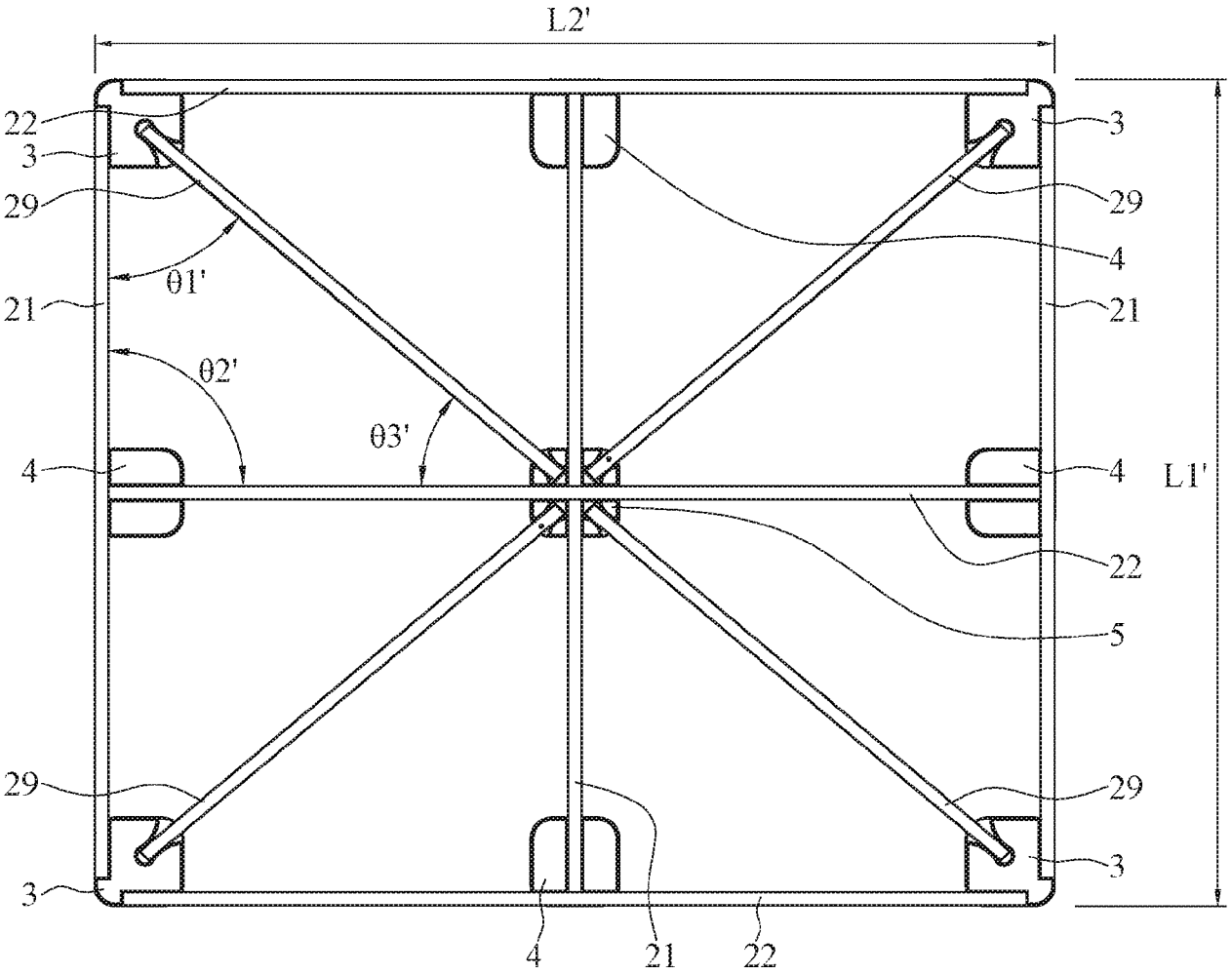
FIG. 28 illustrates a top plan view (2) of a pallet frame of the fourth embodiment.

Please refer to FIGS. 23 to 28. Because the slanted bar 29 is rotatable in the central angled slot 54 and the slanted connecting portion 39, the angle between the slanted bar 29 and the longitudinal bar 21 (or the angle between the slanted bar 29 and the transversal bar 22) can be adjusted, so that pallet frames 2 with different sizes or shaped (rectangle or square) can be manufactured. Please refer to FIGS. 24 and 27. The length L1 of the assemblable pallet 1 (i.e., the distance between opposite outer lateral surfaces of two first base members 3 along the vertical direction) is equal to the width L2 of the assemblable pallet 1 (i.e., the distance between opposite outer lateral surfaces of two first base members 3 along the horizontal direction). For example, the length L1 of the assemblable pallet 1 and the width L2 of the assembable pallet 1 is 1100 cm (centimeter), and the angles between each of the slanted bars 29, the adjacent longitudinal bar 21, and the adjacent transversal bar 22 are respectively 45 degrees (θ1), 90 degrees (θ2), and 45 degrees (θ3). Hence, the two ends of slanted bar 29 are respectively abut against the first connecting section 392 and the central connecting section 542. As shown in FIGS. 24 and 28, if the length L1' of the assemblable pallet 1 (the distance between opposite outer lateral surfaces of two first base members 3 along the vertical direction) is 1000 cm, and the width L2' of the assemblable pallet 1 (the distance between opposite outer lateral surfaces of two first base members 3 along the horizontal direction) is 1200 cm, the angles between each of the slanted bars 29, the adjacent longitudinal bar 21, and the adjacent transversal bar 22 are respectively 52 degrees (θ1'), 90 degrees (θ2), and 38 degrees (θ3'). Although the angles (θ1, θ3) of the assemblable pallet 1 shown in FIG. 27 is different from the angles (θ1', θ3') of the assemblable pallet 1 shown in FIG. 28, the two ends of the slanted bar 29 can be abutted against the first connecting section 392 and the central connecting section 542. In other words, because of the structures of the central exterior expanding section 541, the central interior expanding section 543, the first exterior expanding section 391, and the first interior expanding section 393, after the angles between the longitudinal bar 21, the transversal bar 22, and the slanted bar 29 are changed, one of two ends of each of the slanted bars 29 is still abutted against the corresponding central connecting section 542, and the other end of the slanted bar 29 is still abutted against the first connecting section 392. Therefore, no matter what the size or the shape of the pallet frames 2 changes, the pallet frames 2 can be used or shared with the same central base member 5 and the same first base members 3.

Figure 30:
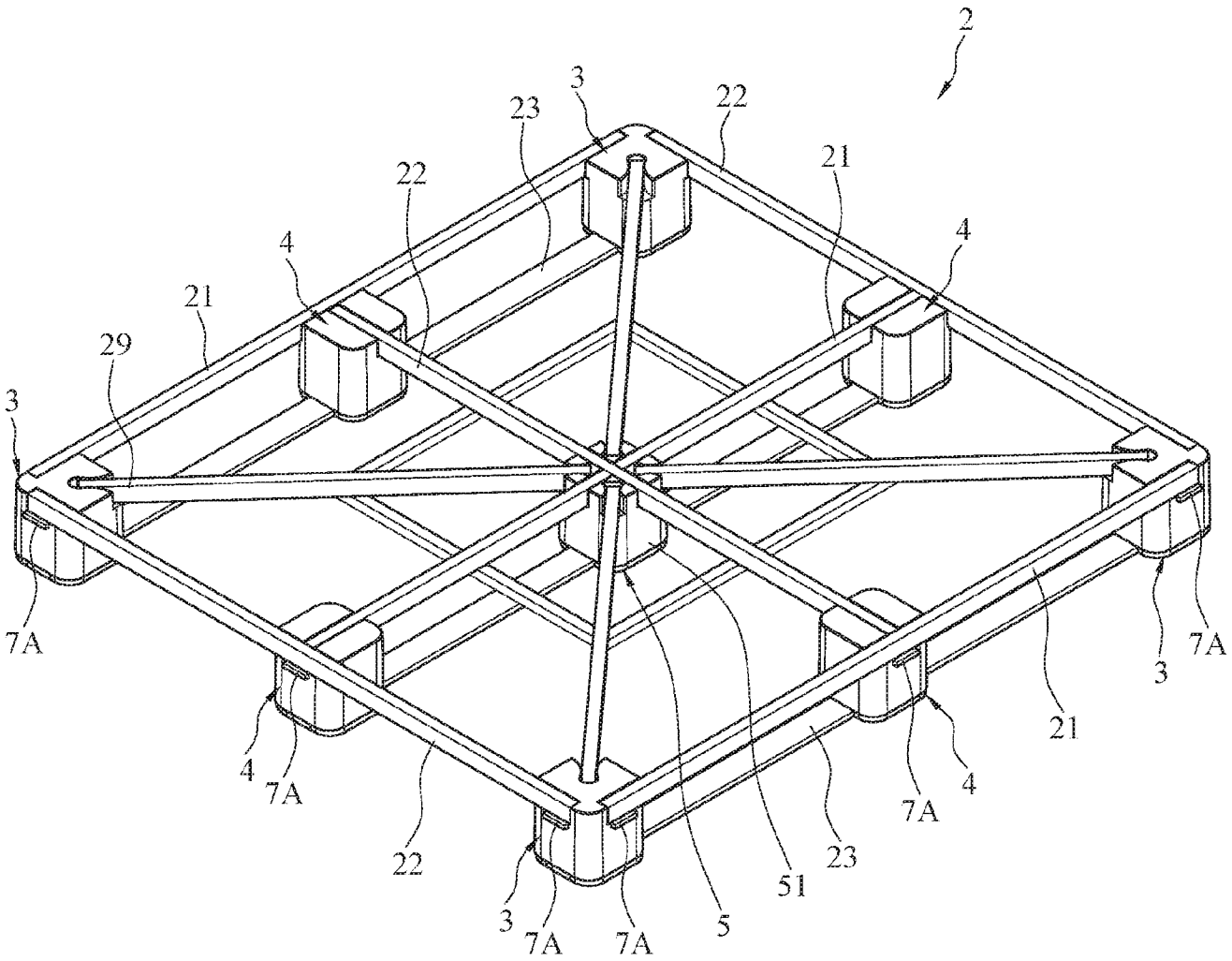
FIG. 30 illustrates a schematic perspective view of the assemblable pallet with protection bars of the fourth embodiment.

In addition, each of the base members may further comprises a protection structure. As shown in FIG. 30, each of the first base members 3 and the second base members 4 comprises a protection bar 7A extending from one side thereof. The protection bar 7A is a protruded structure for buffering external impacts and positioning the pallet frame 2.

Figure 13:
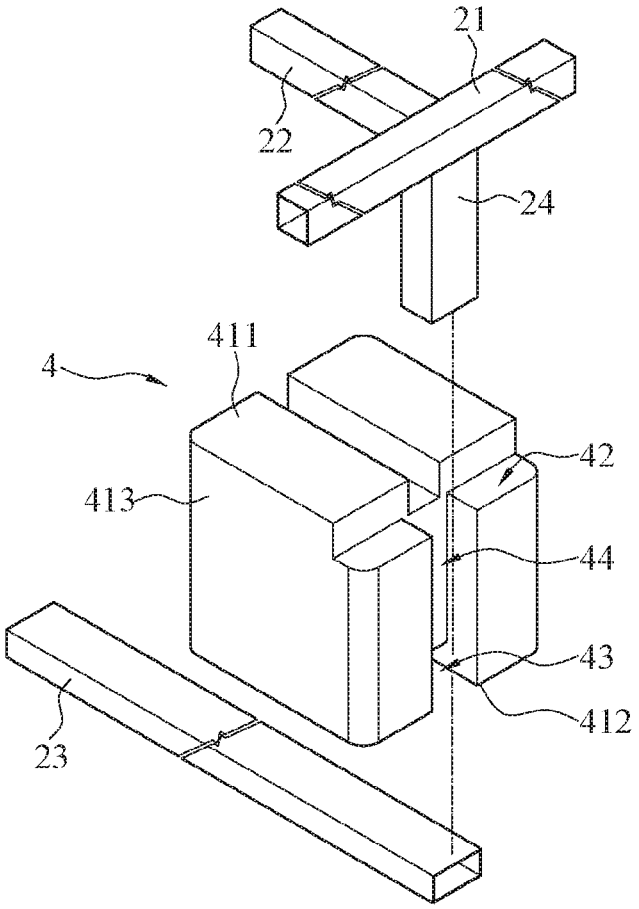
FIG. 13 illustrates a schematic exploded view of the second base member and the pallet frame of the second embodiment.
Figure 14:
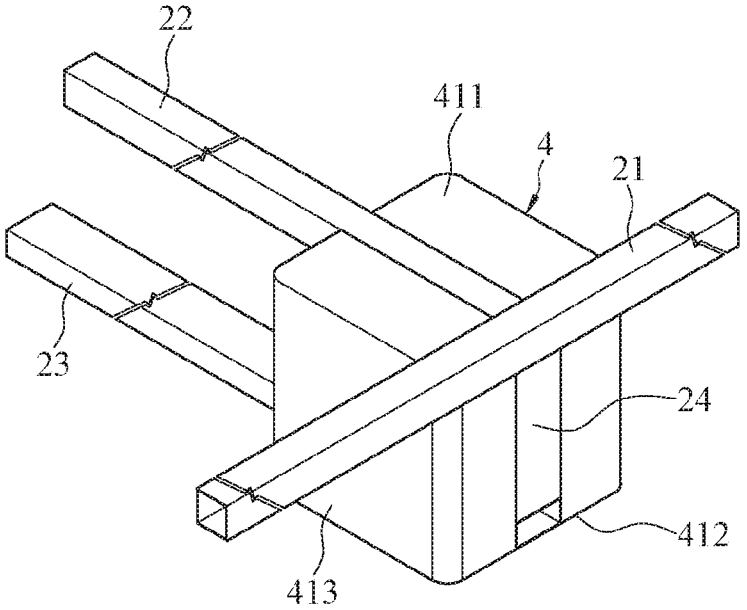
FIG. 14 illustrates a schematic assembled perspective view of the second base member and the pallet frame of the second embodiment.
Figure 21:
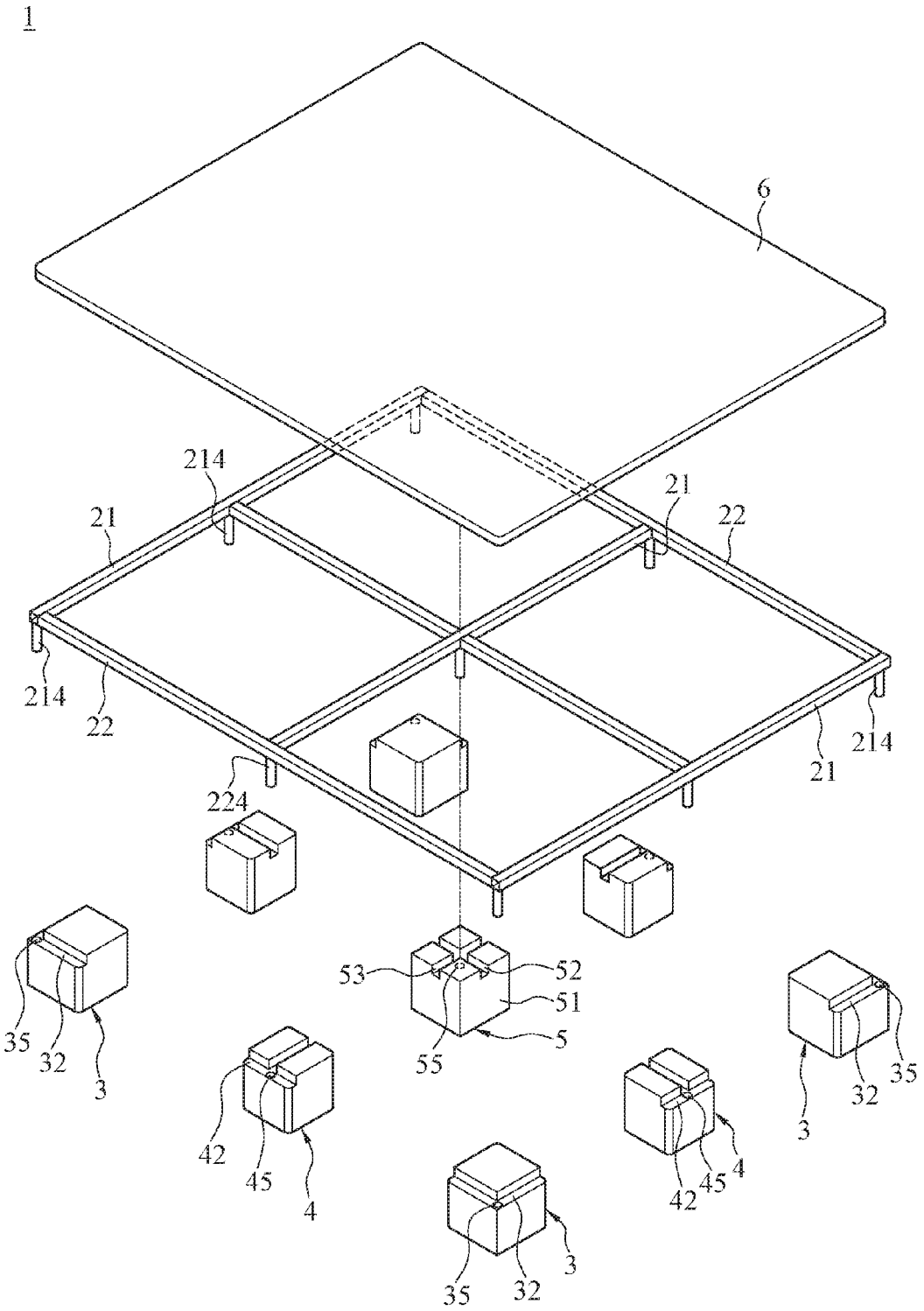
FIG. 21 illustrates a perspective view (2) of the central base member of the third embodiment.

As shown in FIGS. 11, 13, and 14, it is understood that, the longitudinal bars 21 and the transversal bars 22 may be used solely along with the connecting bars 24, solely along with the positioning portions 214, 224 (as shown in FIG. 21), or the longitudinal bars 21 and the transversal bars 22 may also be used aligned with both the connecting bars 24 and the positioning portions 214, 224. In the case that the longitudinal bars 21 and the transversal bars 22 are used along with the connecting bars 24, the connecting bars 24 improve the structural strength of the assembly of the longitudinal bars 21, the transversal bars 22, and the first base members 3. In such case, the positioning portions 214, 224 can be reduced, and the cost of the assemblable pallet 1 can be reduced. In addition, the connecting bar 24 may be soldered with the longitudinal bar 21 or the transversal bar 22, and the connecting bar 24 may be soldered at any portion of the longitudinal bar 21 or the transversal bar 22. For example, as shown in FIGS. 11, 13, and 14, the connecting bar 24 may be soldered at two ends and a middle portion of the bottom surface of the longitudinal bar 21 (or the transversal bar 22), but embodiments are not limited thereto. In some embodiments, the connecting bar 24 may be further soldered at the side portion of the longitudinal bar 21 (or the transversal bar 22), and the positions of the first connecting grooves 34 and the positions of the second grooves 44 correspond to the positions of the connecting bars 24, so that the connecting bars 24 may be held in the first connecting grooves 34 and the second connecting grooves 44 to provide a supporting function for the pallet frame 2.

Accordingly, because of the step-shaped structure, the longitudinal bars and the transversal bars can be guided and assembled with the base members. In other words, the longitudinal bars and the transversal bars may be assembled with each other to form the pallet frame, followed by assembling the first base members and the second base members to the pallet frame. Alternatively, because of the step-shaped structure, the longitudinal bars and the transversal bars may be assembled with the first base members and the second base members, followed by assembling the longitudinal bars with the transversal bars. Therefore, because of the fool-proofing design, the longitudinal bar or the transversal bar would not be unaligned with or protruded from the first top surface during the assembly, and the assemblable pallet can be assembled in an efficient and convenient way. As a result, a fool-proofing function can be performed during the assembly of the pallet frame and the first base members. In addition, when some of the components are damaged, the damaged components can be replaced by a new component. Hence, the cost for the assembable pallet can be reduced, and the assemblable pallet can be repaired easily.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An assemblable pallet, comprising:

a pallet frame comprising a plurality of longitudinal bars and a plurality of transversal bars, wherein each of the longitudinal bars and the transversal bars has a step-shaped positioning portion;

a plurality of first base members located at corners of the pallet frame, wherein each of the first base members comprises:

a first base body having a first top surface, a first bottom surface, and a plurality of first lateral surfaces, wherein each of the first lateral surfaces is connected between the first top surface and the first bottom surface; and a plurality of first step-shaped connecting portions formed between the first top surface and two of the first lateral surfaces of the first base body, wherein the first step-shaped connecting portions are connected with each other and guide the step-shaped positioning portion of one of the longitudinal bars and the step-shaped positioning portion of one of the transversal bars, so that the longitudinal bar and the transversal bar are assembled on the first base body through the first step-shaped connecting portions;

a plurality of second base members each located between two of the first base members, wherein each of the second base members comprises:

a second base body having a second top surface, a second bottom surface, and a plurality of second lateral surfaces, wherein each of the second lateral surfaces is connected between the second top surface and the second bottom surface; and a second step-shaped connecting portion formed between the second top surface and one of the second lateral surfaces of the second base body, wherein the second step-shaped connecting portion guides the step-shaped positioning portion of one of the longitudinal bars or the step-shaped positioning portion of one of the transversal bars, so that the longitudinal bar or the transversal bar is assembled on the second base body through the second step-shaped connecting portions; and a loading plate fixed on the pallet frame and attached to the pallet frame, the first top surfaces of the first base members, and the second top surfaces of the second base members.

2. The assemblable pallet according to claim 1, wherein the stair number of the first step-shaped connecting portion and the stair number of the second step-shaped connecting portion is greater than the stair number of the step-shaped positioning portion.

3. The assemblable pallet according to claim 1, wherein the pallet frame further comprises a plurality of bottom supporting bars, each of the first base members further comprises a first fixing groove formed on the first bottom surface thereof, each of the second base members further comprises a second fixing groove formed on the second bottom surface thereof, some of the bottom supporting bars are held in two first fixing grooves of two first base members so as to position the two first base members, and the rest of the bottom supporting bars are held in two second fixing grooves of two second base members so as to position the two second base members.

4. The assemblable pallet according to claim 3, wherein the pallet frame further comprises a plurality of connecting bars each connected to one of the longitudinal bars and one of the bottom supporting bars or connected to one of the transversal bars and one of the bottom supporting bars.

5. The assemblable pallet according to claim 4, wherein each of the first base members further comprises a first connecting groove formed on one of the first lateral surfaces, the first connecting groove is connected to one of the first step-shaped connecting portions and the first fixing groove, each of the second base members further comprises a second connecting groove formed on one of the second lateral surfaces, the second connecting groove is connected to the second step-shaped connecting portion and the second fixing groove, the connecting bars are held in the first fixing grooves and the second fixing grooves.

6. The assemblable pallet according to claim 1, wherein the pallet frame further comprises a plurality of reinforced bars connected to the longitudinal bars or the transversal bars.

7. The assemblable pallet according to claim 6, wherein one of the reinforced bars is connected to the longitudinal bars, and the adjacent reinforced bar is connected to the transversal bars.

8. The assemblable pallet according to claim 1, wherein one end of the step-shaped positioning portion of the longitudinal bar is extending to form a protruded portion, the protruded portion is held in the step-shaped positioning portion of the transversal bar.

9. The assemblable pallet according to claim 1, wherein one end of the step-shaped positioning portion of the transversal bar is extending to form a protruded portion, the protruded portion is held in the step-shaped positioning portion of the longitudinal bar.

10. The assemblable pallet according to claim 1, wherein the pallet frame further comprises a slanted bar and a central base member, the central base member further comprises a central angled slot, the first base member further comprises a slanted connecting portion, the two ends of the slanted bar is respectively inserted into the central angled slot and the slanted connecting portion so as to position the central base member and the first base member.

11. The assemblable pallet according to claim 10, wherein the central angled slot comprises a central exterior expanding section, a central connecting section, and a central interior expanding section, the central connecting section is connected between the central exterior expanding section and the central interior expanding section, and the width of the central connecting section is smaller than the width of the central exterior expanding section and the width of the central interior expanding section.

12. The assemblable pallet according to claim 10, wherein the slanted connecting portion comprises a first exterior expanding section, a first connecting section, and a first interior expanding section, the first connecting section is connected between the first exterior expanding section and the first interior expanding section, and the width of the first connecting section is smaller than the width of the first exterior expanding section and the width of the first interior expanding section.

13. The assemblable pallet according to claim 10, wherein the central base member, the first base members, and the second base members further comprise a plurality of inserting holes respectively formed in the central angled slot, the first step-shaped connecting portions, and the second step-shaped connecting portions, the longitudinal bars and the transversal bars respectively have a plurality of positioning portions at two ends thereof, the positioning portions are inserted into the inserting holes, so that the pallet frame is firmly fixed on the first base members, the second base members, and the central base member.

14. The assemblable pallet according to claim 10, wherein each of the central base member, the first base members, and the second base members comprises a protection bar extending from one side thereof.

* * * * *